US011339522B2

(12) United States Patent
Park et al.

(10) Patent No.: US 11,339,522 B2
(45) Date of Patent: May 24, 2022

(54) LAUNDRY TREATING APPARATUS

(71) Applicant: LG ELECTRONICS INC., Seoul (KR)

(72) Inventors: Juhyeong Park, Seoul (KR); Dongwon Kang, Seoul (KR); Donghyun Jin, Seoul (KR)

(73) Assignee: LG Electronics Inc., Seoul (KR)

( * ) Notice: Subject to any disclaimer, the term of this patent is extended or adjusted under 35 U.S.C. 154(b) by 189 days.

(21) Appl. No.: 16/778,527

(22) Filed: Jan. 31, 2020

(65) Prior Publication Data

US 2020/0248377 A1 Aug. 6, 2020

(30) Foreign Application Priority Data

Feb. 1, 2019 (KR) ..... 10-2019-0014084
Apr. 22, 2019 (KR) ..... 10-2019-0046867

(51) Int. Cl.
*D06F 39/02* (2006.01)
*D06F 39/08* (2006.01)
(Continued)

(52) U.S. Cl.
CPC ..... *D06F 39/028* (2013.01); *D06F 39/088* (2013.01); *D06F 39/12* (2013.01);
(Continued)

(58) Field of Classification Search
CPC ..... D06F 39/02; D06F 39/022; D06F 39/028; D06F 39/088; D06F 39/12; D06F 33/34;
(Continued)

(56) References Cited

U.S. PATENT DOCUMENTS 5,588,313 A * 12/1996 Hildebrand ..... D06F 25/00 68/17 R
7,578,150 B2 * 8/2009 Zsambeki ..... D06F 39/088 68/17 R
(Continued)

FOREIGN PATENT DOCUMENTS

KR 20070002540 A * 1/2007
WO WO-03044256 A1 * 5/2003 ..... D06F 39/02
WO WO-2017057940 A1 * 4/2017 ..... D06F 39/028

OTHER PUBLICATIONS

Machine translation of KR-20070002540-A. (Year: 2007).*

*Primary Examiner* — Joseph L. Perrin
(74) *Attorney, Agent, or Firm* — Fish & Richardson P.C.

(57) ABSTRACT

A laundry treating apparatus includes a cabinet, a water tub provided inside the cabinet, and a detergent box to supply detergent to the water tub. The detergent box includes a housing connected to communicate with the water tub, a drawer having a plurality of detergent storage spaces and received in the housing to be drawn out, and a distribution unit to distributively supply wash water into the plurality of detergent storage spaces. The housing may include a through portion communicating with the water tub, a horizontal partition protruding above the through portion and disposed in a left and right direction, and a wash water guide unit to guide the wash water so that a plurality of wash water movement paths is defined at a front region of the horizontal partition. Accordingly, detergent residue at an inner front region of the housing can be suppressed.

20 Claims, 25 Drawing Sheets

(51) Int. Cl.

| | |
|---|---|
| ***D06F 39/12*** | (2006.01) |
| ***D06F 105/06*** | (2020.01) |
| ***D06F 105/02*** | (2020.01) |
| ***D06F 105/38*** | (2020.01) |
| ***D06F 103/38*** | (2020.01) |

(52) U.S. Cl.
CPC ..... *D06F 2103/38* (2020.02); *D06F 2105/02* (2020.02); *D06F 2105/06* (2020.02); *D06F 2105/38* (2020.02)

(58) Field of Classification Search
CPC .. D06F 33/37; D06F 2103/38; D06F 2105/02; D06F 2105/06; D06F 2105/38
See application file for complete search history.

(56) References Cited

U.S. PATENT DOCUMENTS

| | | | | |
|---|---|---|---|---|
| 2012/0017653 | A1* | 1/2012 | Doh | D06F 39/02 68/17 R |
| 2017/0183807 | A1* | 6/2017 | Cinello | D06F 39/028 |
| 2017/0350060 | A1* | 12/2017 | Favaro | D06F 39/028 |
| 2018/0282931 | A1* | 10/2018 | Kim | D06F 39/028 |

* cited by examiner

LAUNDRY TREATING APPARATUS

CROSS-REFERENCE TO RELATED APPLICATION

Pursuant to 35 U.S.C. § 119(a), this application claims the benefit of an earlier filing date of and the right of priority to Korean Patent Application No. 10-2019-0014084, filed on Feb. 1, 2019, and Korean Patent Application No. 10-2019-0046867, filed on Apr. 22, 2019, the contents of which are incorporated by reference herein in its entirety.

BACKGROUND

1. Technical Field

The present disclosure relates to a laundry treating apparatus.

2. Description of the Related Art

As is well known, a laundry treating apparatus is a kind of apparatus for treating (decontaminating) clothes or laundry through a washing process, a rinsing process and/or a dehydration (dewatering) process. The laundry treating apparatus is further provided with a drying function of drying the laundry which has undergone the washing process, rinsing process and/or dehydration process. The laundry includes items that can be washed, such as bedding like bedclothes, curtains, stuffed dolls, and the like.

The laundry treating apparatus includes a cabinet, a water tub provided in the cabinet, and a rotating tank (drum) rotatably provided in the water tub. The cabinet is provided with a detergent box to supply detergent to inside of the water tub. The detergent box is provided with a housing provided in the cabinet, and a drawer that can be drawn out of and pushed into the housing.

A detergent storage (accommodation) space is formed inside the drawer. The detergent storage space may include, for example, a main detergent storage portion storing a main detergent to be used during main-wash, and a pre-detergent storage portion storing pre-detergent to be used during pre-wash, and a softener storage portion storing a fabric softener.

A distribution unit for distributing wash water to each detergent storage portion of the drawer is provided above the drawer. A wash water supply passage through which wash water is introduced is connected to a rear end of the distribution unit.

The housing has a cylindrical shape opened upwardly. A front region of the housing is opened so that the drawer can be received to move back and forth. A wash water supply pipe having one end connected to the water tub is connected to a bottom of the housing. Wash water, detergent, fabric softener, etc. are supplied into the water tub through the wash water supply pipe.

By the way, in the related art laundry treating apparatus, the detergent which is dropped down into the housing together with the wash water via the detergent storage space of the drawer remains in the housing without being smoothly supplied to the water tub.

The detergent remaining in the housing after being in contact with the wash water is hardened and is not easily dissolved even when it is brought into contact (wetted) with the wash water. In addition, the hardened detergent disturbs the flow of wash water, which causes much more detergent to remain in the housing.

SUMMARY

Therefore, one aspect of the present disclosure is to provide a laundry treating apparatus having a detergent box, capable of suppressing detergent from remaining in the detergent box.

Another aspect of the present disclosure is to provide a laundry treating apparatus having a detergent box, capable of washing out residual detergent by wash water supplied after an occurrence of detergent residue in a housing.

Still another aspect of the present disclosure is to provide a laundry treating apparatus having a detergent box, capable of smoothly distributing wash water into a housing along a plurality of movement paths inside the housing.

A laundry treating apparatus according to the present disclosure to solve the above problems is characterized in that a plurality of wash water movement paths is formed at an inner front region of a housing of a detergent box.

More specifically, a through portion communicating with a water tub may be formed through a bottom of a housing of a detergent box, a horizontal partition disposed in left and right directions may protrude above the through portion, and a wash water guide unit may be provided to guide wash water so that a plurality of wash water movement paths can be defined at a front region of the horizontal partition. With this configuration, detergent remaining at the inner front region of the housing can be washed out by the wash water guided by the wash water guide unit, thereby suppressing detergent residue.

The laundry treating apparatus may include a cabinet defining appearance and a water tub provided in the cabinet.

The cabinet may be provided with a detergent box, and the detergent box may include a housing communicating with the water tub, a drawer received in the housing to be drawn out, and a distribution unit for selectively supplying water into the drawer in a distributing manner.

The drawer may be provided with a plurality of detergent storage spaces therein for storing detergent.

The housing may include a plurality of side portions for accommodating the drawer, and a bottom portion disposed below the drawer. The bottom portion may be provided with the through portion communicating with the water tub, and a plurality of inclined sections inclined to allow the wash water to be moved toward the through portion.

The horizontal partition may be disposed above the through portion at a more forward from a center of the through portion. With this configuration, wash water moved from a rear region of the housing to the through portion can be moved into the water tub through a rear region of the horizontal partition, of an inner space of the through portion, and wash water moved to a front region of the horizontal partition can be moved into the water tub through a front region of the horizontal partition, of the inner space of the through portion.

More specifically, the laundry treating apparatus may include a cabinet, a water tub provided inside the cabinet, and a detergent box to supply detergent to the water tub. The detergent box may include a housing connected to communicate with the water tub, a drawer having a plurality of detergent storage spaces and received in the housing to be drawn out, and a distribution unit to supply wash water into the plurality of detergent storage spaces in a distributing manner. The housing may include a through portion communicating with the water tub, a horizontal partition protruding above the through portion and disposed in a left and right direction, and a wash water guide unit to guide the wash water so that a plurality of wash water movement paths is defined at a front region of the horizontal partition. With this configuration, detergent residue in the housing can be suppressed.

The wash water guide unit may include a vertical partition protruding at one side of the horizontal partition and disposed in a back and forth direction of the housing, and an extension partition formed at the front of the vertical partition in a spaced manner.

With this configuration, part of the wash water dropped into a rear region of the housing can be moved through between the vertical partition and the extension partition, and another part can be moved to a front region of the extension partition. Accordingly, detergent remaining at the front region of the horizontal partition can be washed out, thereby suppressing the detergent residue at the front region of the horizontal partition in the housing.

The extension partition may include a first extension partition disposed at one side of the vertical partition, and a second extension partition disposed at one side of the first extension partition.

With this configuration, part of the wash water moved along the vertical partition can be moved between the vertical partition and the first extension partition, another part can be moved between the first extension partition and the second extension partition, and still another part can be moved to a front region of the second extension partition to flow toward the through portion, thereby suppressing the detergent residue at the front region of the horizontal partition.

The first extension partition may include a first extension partition body, and a first bent end portion bent from an end portion of the first extension partition body.

With this configuration, wash water moved along the first extension partition body can be stably moved into a lower space between the first extension partition body and a second extension partition body.

The second extension partition may include a second extension partition body, and a second bent end portion bent from an end portion of the second extension partition body.

With this configuration, wash water moved along the second extension partition body can be stably moved into a lower space of the second extension partition body.

The extension partition may be disposed below the vertical partition with a height difference.

With this configuration, wash water moved along the vertical partition can be dropped at an increased speed, so as to be smoothly moved at an upper side of the extension partition.

The first extension partition may be disposed below the vertical partition with a height difference, and the second extension partition may be disposed below the first extension partition with a height difference. Accordingly, wash water moved along the vertical partition can be dropped at an increased speed so as to be moved along the first extension partition, and then dropped again at an increased speed so as to be smoothly moved along the second extension partition.

The vertical partition and the extension partition may be inclined downward toward the front of the housing.

This may allow a smooth flow of the wash water moved along the vertical partition and the extension partition.

The wash water guide unit may include a vertical partition protruding from a bottom surface of the housing at one side of the horizontal partition and disposed in a back and forth direction of the housing, and an outlet allowing the wash water to be moved through the vertical partition.

With this configuration, part of the wash water moved along the vertical partition can be moved downward through the outlet, and another part can be moved downward from a front end portion of the vertical partition, thereby defining a plurality of wash water movement paths at a front region of the horizontal partition.

The vertical partition may be inclined downward toward the front of the housing. Accordingly, the wash water moved along the vertical partition can flow smoothly.

The outlet may be formed through a boundary region between the vertical partition and the bottom surface. The wash water discharged through the outlet may be moved along the bottom surface.

The outlet may be provided with a rib extending downward.

The wash water guide unit may include a vertical partition protruding from a bottom surface of the housing at one side of the horizontal partition and disposed in a back and forth direction of the housing, and a guide member coupled to the vertical partition to extend in the back and forth direction, and having an outlet allowing the wash water to flow to the front of the horizontal partition therethrough.

Accordingly, various wash water movement paths can be defined at the front region of the horizontal partition by adjusting a length of the guide member, and number and size of the outlet.

Here, the guide member may be provided with a coupling portion coupled with the vertical partition.

The coupling portion may be recessed into the guide member in a thickness direction of the guide member.

The housing may be provided with a ventilation portion communicating inside and outside of the housing with each other, and an upper end portion of the horizontal partition may be located lower than the ventilation portion.

With this configuration, detergent remaining at the front of the horizontal partition over the horizontal partition due to restriction of a height of the upper end of the horizontal partition can be washed out by the wash water moved along the plurality of wash water movement paths defined by the wash water guide unit and thus moved out through the through portion, thereby suppressing the detergent residue at the front region of the horizontal partition in the housing.

The drawer may be provided therein with a main detergent storage portion configured to store detergent to be used during main-wash, a pre-detergent storage portion configured to store detergent to be used during pre-wash, and a fabric softener storage portion configured to store fabric softener.

The wash water guide unit may guide the wash water passed through the pre-detergent storage portion to be moved to the front region of the horizontal partition along the plurality of wash water movement paths.

With this configuration, when the detergent remains at the front region of the horizontal partition due to the wash water moved over the horizontal via the main detergent storage portion, the remaining detergent can be washed out by the wash water moved along the plurality of movement paths guided by the wash water guide unit, thereby suppressing the detergent residue at the front region of the housing.

The through portion may have a circular cross section.

The horizontal partition may divide the through portion in a back and forth direction at a region more forward from a center of the through portion.

With this configuration, more fluid can flow to the rear region of the horizontal partition with a relatively great flow cross section, thereby suppressing detergent and wash water from being moved to the front region of the horizontal partition.

The housing may be provided on a bottom surface thereof with a horizontal section having the through portion, and a plurality of inclined sections inclined toward the through portion.

The plurality of inclined sections may be provided with a first inclined section disposed to be inclined downward in the left and right direction of the housing.

The horizontal partition may be formed over the horizontal section and the first inclined section, and the wash water guide unit may be formed on the first inclined section.

The wash water passed through the pre-detergent storage portion may be dropped down to the inner rear region of the housing. The wash water guide unit may be spaced a preset distance apart from a rear end portion of the housing so that part of the wash water passed through the pre-detergent storage portion is moved to the rear region of the horizontal partition.

With this configuration, part of the wash water passed through the pre-detergent storage portion can be moved through between a rear end portion of the wash water guide unit and a rear end portion of the housing so as to be moved to the rear region of the horizontal partition, and another part may be guided by the wash water guide unit to be moved to the front region of the horizontal partition along the plurality of wash water movement paths, thereby suppressing the detergent residue at the front region of the horizontal partition in the housing.

As described above, according to one embodiment of the present disclosure, by configuring a horizontal partition disposed in a left and right direction above a through portion in a housing of a detergent box, and a wash water guide unit to guide wash water to form a plurality of wash water movement paths at a front region of the horizontal partition, detergent residue in the detergent box can be suppressed.

In addition, the wash water guide unit may be provided with a vertical partition protruding at one side of the horizontal partition and disposed in a back and forth direction of the housing, and an extension partition formed at the front of the vertical partition in a spaced manner. Accordingly, a plurality of wash water movement paths can be defined at the front region of the horizontal partition, thereby suppressing the detergent residue.

The extension partition may include a first extension partition disposed at one side of the vertical partition, and a second extension partition formed at one side of the first extension partition. Accordingly, more various wash water movement paths can be defined at the front of the horizontal partition, thereby effectively suppressing the detergent residue.

The extension partition may be disposed below the vertical partition with a height difference, thereby allowing smooth movement of the wash water.

The vertical partition and the extension partition may be inclined downward toward the front of the housing, thereby allowing smooth movement of the wash water.

In addition, by configuring a vertical partition protruding from a bottom surface of the housing at one side of the horizontal partition and disposed in a back and forth direction, and an outlet to allow the wash water to flow through the vertical partition, various wash water movement paths can be defined at the inner front region of the housing, thereby suppressing the detergent residue.

The wash water guide unit may include a vertical partition protruding from a bottom surface of the housing at one side of the horizontal partition and disposed in a back and forth direction of the housing, and a guide member coupled to the vertical partition to extend in the back and forth direction, and having an outlet allowing the wash water to flow to the front of the horizontal partition therethrough. Accordingly, the plurality of wash water movement paths can be defined at the front region of the horizontal partition, thereby suppressing the detergent residue.

Since the guide member is configured to be replaceable, various wash water movement paths can be defined at the front region of the horizontal partition in the housing through adjustment or replacement of the guide member.

The housing may also be provided with a through portion through which inside and outside of the housing communicate with each other, and the horizontal partition may be disposed below the through portion, so as to suppress the detergent residue at the front region of the horizontal partition in the housing without increasing the height of the horizontal partition.

In addition, the drawer may be provided with a main detergent storage portion storing detergent to be used during main wash, a pre-detergent storage portion storing detergent to be used during pre-wash, and a fabric softener storage portion storing fabric softener, and the wash water guide unit may guide wash water passed through the pre-detergent storage portion to be moved to the front region of the horizontal partition along the plurality of movement paths, thereby suppressing the detergent residue at the front region of the horizontal partition in the housing.

DETAILED DESCRIPTION OF THE EMBODIMENTS

Hereinafter, embodiments disclosed in this specification will be described in detail with reference to the accompanying drawings. In this specification, the same or equivalent components may be provided with the same or similar reference numbers even in different embodiments, and description thereof will not be repeated. A singular representation may include a plural representation unless it represents a definitely different meaning from the context. In describing the present disclosure, if a detailed explanation for a related known technology or construction is considered to unnecessarily divert the gist of the present disclosure, such explanation has been omitted but would be understood by those skilled in the art. It should be noted that the attached drawings are provided to facilitate understanding of the embodiments disclosed in this specification, and should not be construed as limiting the technical idea disclosed in this specification by the attached drawings.

Figure 1:
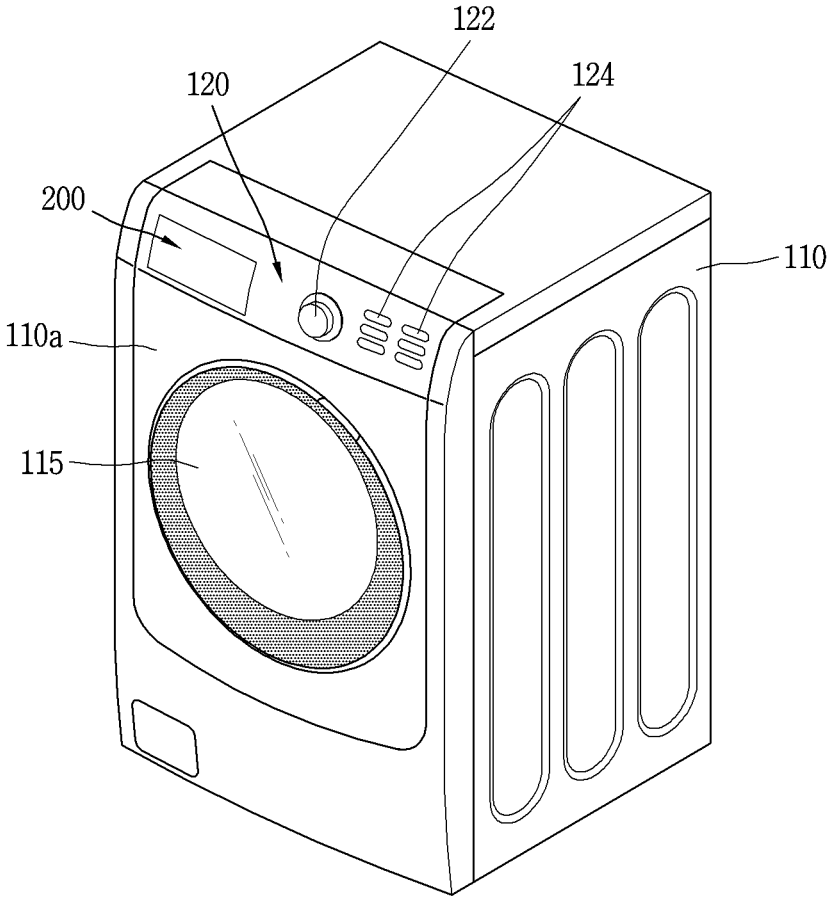
FIG. 1 is a perspective view of a laundry treating apparatus in accordance with one embodiment.
Figure 2:
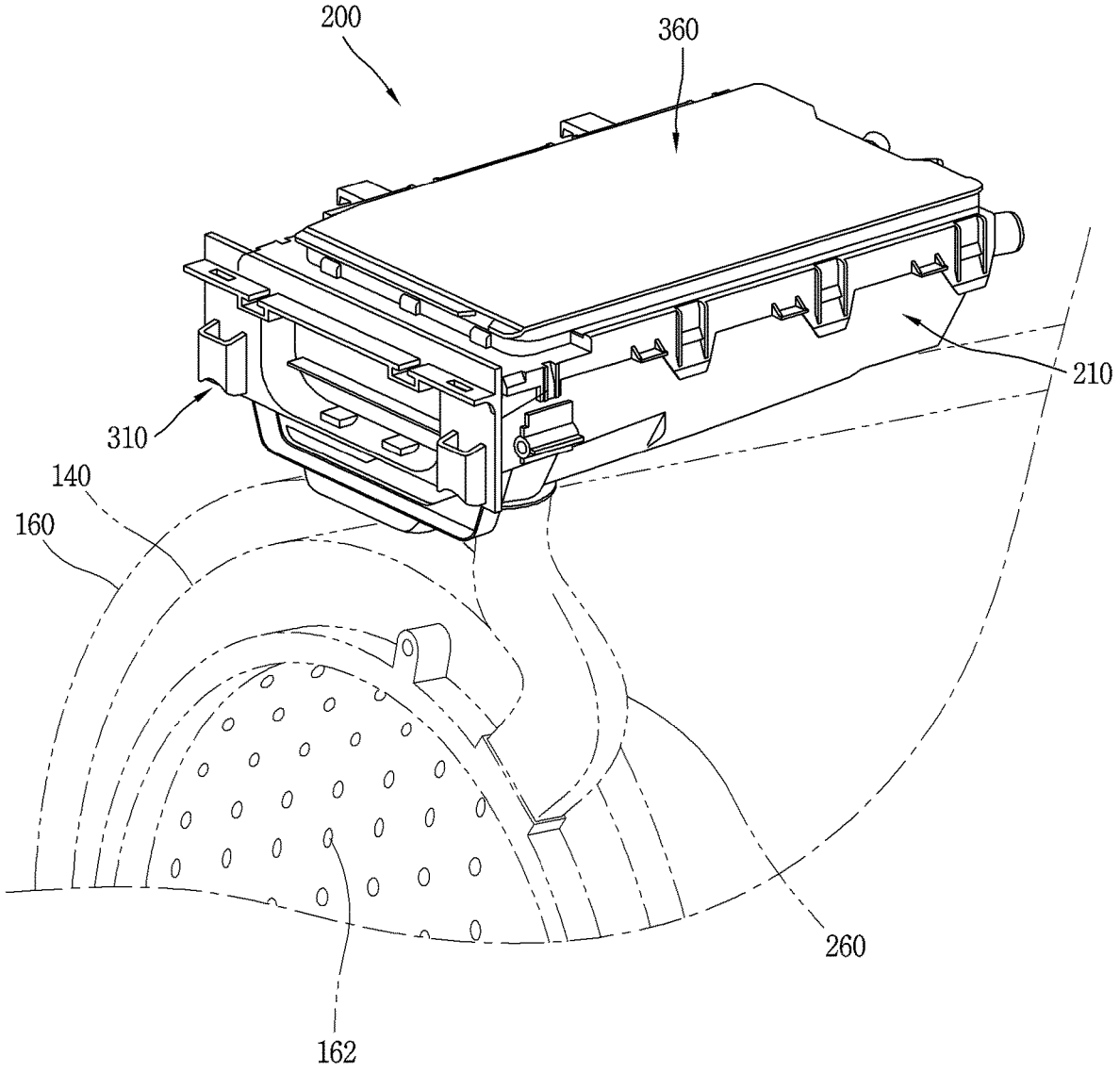
FIG. 2 is a perspective view of a detergent box of FIG. 1.

FIG. 1 is a perspective view of a laundry treating apparatus in accordance with one embodiment, and FIG. 2 is a perspective view of a detergent box of FIG. 1. As illustrated in FIGS. 1 and 2, a laundry treating apparatus according to one embodiment disclosed herein may include a cabinet 110, a water tub 140 and a detergent box 200.

The cabinet 110 defines appearance of the laundry treating apparatus. The cabinet 110 may have a substantially rectangular parallelepiped shape. The water tub 140 is provided inside the cabinet 110. The water tub 140 defines an accommodation space of wash water therein. The water tub 140 has a cylindrical shape with a front opening. A drum 160 is provided inside the water tub 140. The drum 160 has a cylindrical shape with a front opening. The drum 160 is provided with a plurality of through holes 162 on a circumferential surface thereof. The inside of the drum 160 communicates with an inside of the water tub 140 through the front opening of the drum 160 and the plurality of through holes 162. The drum 160 rotates centering on a rotational shaft (not illustrated) provided at its rear end. A drum driving motor (not illustrated) for rotating the drum 160 is provided at the rear end of the water tub 140.

The cabinet 110 is provided with a front opening. The front opening of the cabinet 110 communicates with the opening of the water tub 140 and the opening of the drum 160. Accordingly, the clothes (the laundry) can be introduced into the drum 160. A door 115 for opening and closing the opening is provided on the front surface of the cabinet 110. The door 115, for example, rotates up and down centering on a rotational shaft (not illustrated) disposed at the cabinet 110. The cabinet 110 is provided with a control panel 120 to select an operation mode.

The control panel 120 may be provided on a front surface of the cabinet 110. The control panel 120 includes a dial 122 and a plurality of control buttons 124 for selecting and inputting signals. The cabinet 110 is provided with a detergent box 200 for supplying detergent into the water tub 140.

The detergent box 200, for example, is provided with a housing 210, a drawer 310, and a distribution unit 360. The housing 210 is provided in the cabinet 110. The distribution unit 360 is provided at an upper side of the housing 210. The drawer 310 is accommodated inside the housing 210 to be drawn out. The distribution unit 360 is disposed at an upper end of the housing 210 to be spaced apart from a bottom of the housing 210. The drawer 310 is inserted into and drawn out of a lower space of the distribution unit 360 inside the housing 210.

Figure 3:
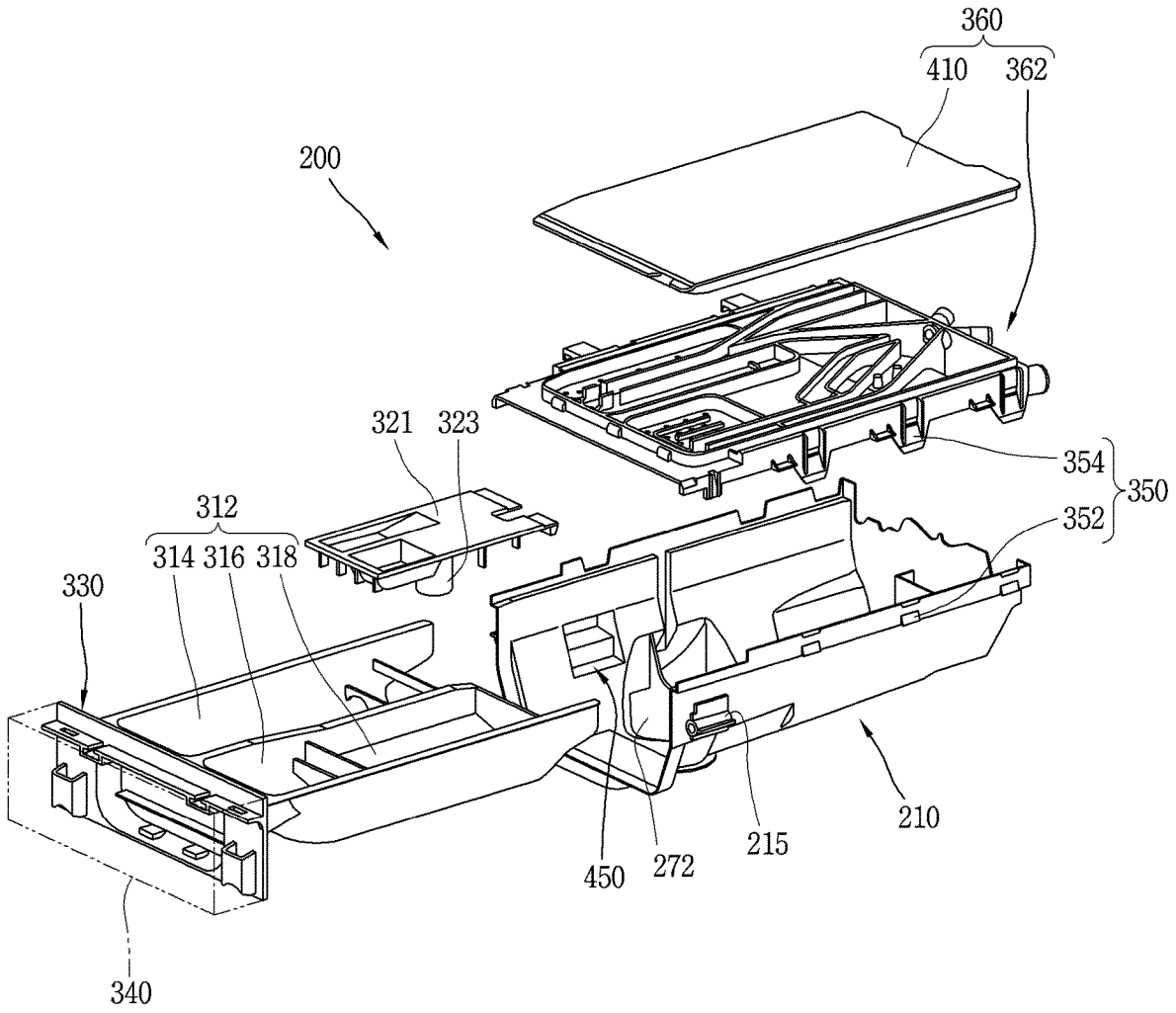
FIG. 3 is an exploded perspective view of the detergent box of FIG. 2.

FIG. 3 is an exploded perspective view of the detergent box 200 of FIG. 2. As illustrated in FIG. 3, the housing 210 is implemented to define an inner accommodation space having a substantially rectangular parallelepiped shape. The housing 210 is open at its upper and front sides, for example. The distribution unit 360 is disposed at the upper side of the housing 210. The distribution unit 360 is coupled to block the upper opening of the housing 210. The distribution unit 360 is engaged with the housing 210 in an up and down direction.

An engagement coupling portion 350 is provided on a mutual contact area between the housing 210 and the distribution unit 360. The engagement coupling portion 350, for example, is provided with stopping jaws 352 formed on any one of the housing 210 and the distribution unit 360, and stopping jaw accommodating portions 354 formed on the other for accommodating the stopping jaw 352. The stopping jaws 352 may be provided on the housing 210. The stopping jaw accommodating portions 354 may be provided on the distribution unit 360.

The distribution unit 360 may include a distribution unit body 362 having a plurality of wash water movement paths 390 therein, and an upper cover 410 coupled to block an upper side of the distribution unit body 362. The distribution unit body 362 is provided therein with wash water movement paths 390 that are upwardly opened. The upper cover 410 is implemented in a rectangular plate shape of a size corresponding to the distribution unit body 362. The upper cover 410, for example, may be disposed on a top of the distribution unit body 362 and integrally coupled to the distribution unit body 362 by fusion.

The drawer 310 may be accommodated in the housing 210 to be pulled out through the front opening of the housing 210. The drawer 310 is provided with a plurality of detergent storage spaces 312 therein. The plurality of detergent storage spaces 312 may include, for example, a main detergent storage portion 314 in which a main detergent to be used during main-wash is stored (accommodated). The plurality of detergent storage spaces 312 includes a pre-detergent storage portion 316 in which a pre-detergent to be used during pre-wash is stored. Here, the main detergent and the pre-detergent may be the same detergent or different detergents. The plurality of detergent storage spaces 312 also includes a fabric softener storage portion 318 in which a liquid detergent or a fabric softener (hereinafter, referred to as "fabric softener") is stored. A siphon generating member 321 for allowing the fabric softener to be supplied downward by a siphon phenomenon is coupled to the fabric softener storage portion 318. A front blocking portion 330 for blocking the front opening of the housing 210 when the drawer 310 is accommodated in the housing 210 is provided at a front region of the drawer 310. The front blocking portion 330 is provided with a front cover 340 coupled to the front thereof.

Figure 4:
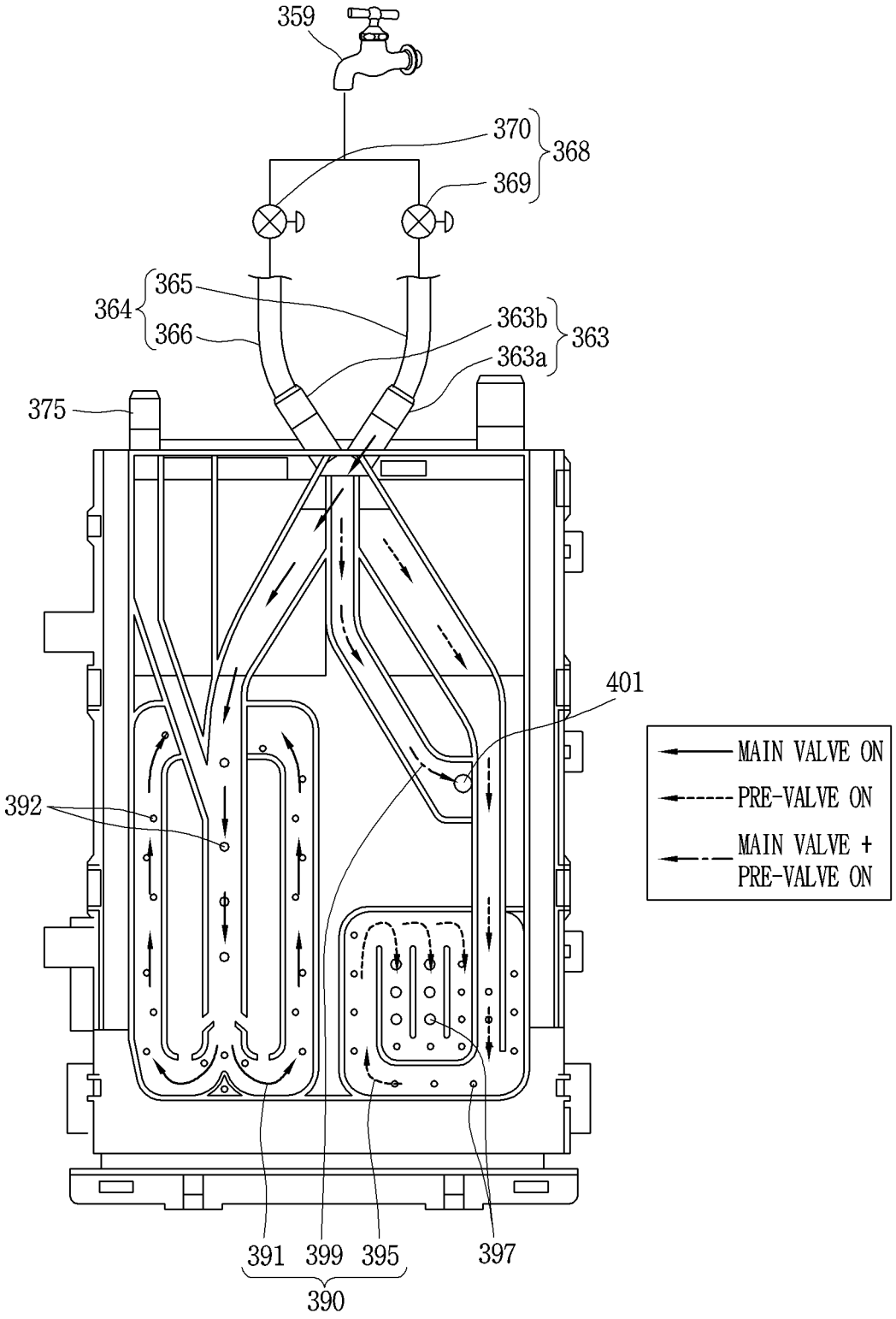
FIG. 4 is a planar view of a distribution unit body of FIG. 3.

FIG. 4 is a planar view of the distribution unit body 362 of FIG. 3. As illustrated in FIG. 4, the plurality of wash water movement paths 390 are provided in the distribution unit body 362. A wash water supply passage 364 is connected to a rear end of the distribution unit body 362. The wash water supply passage 364 includes a main-wash water supply passage 365 for supplying wash water during main-wash. The wash water supply passage 364 includes a pre-wash water supply passage 366 for supplying wash water during pre-wash. Here, the pre-wash refers to a process of rotating or stopping the drum 160 at a preset speed for a preset time in order to perform a role of keeping contaminated laundry soaked in water in advance or removing contamination of the laundry. The main-wash refers to a process of removing the contamination from the laundry in earnest by using a chemical action of the detergent and a physical action of the drum 160, namely, typically refers to a process of rotating the drum 160 forward or backward for a preset time at a faster rotational speed than that in the pre-wash.

The main-wash water supply passage 365 is provided with a main valve 369 to open and close the passage. The pre-wash water supply passage 366 is provided with a pre-valve 370 to open and close the passage. The main-wash water supply passage 365 and the pre-wash water supply passage 366 are connected to a faucet 359 of a water supply. The faucet 359 of the water supply is typically kept open, and the main valve 369 and the pre-valve 370 are typically kept closed.

The distribution unit body 362 is provided with a main-wash water supply passage connecting portion 363*a* to which the main-wash water supply passage 365 is connected. The distribution unit body 362 is provided with a pre-wash water supply passage connecting portion 363*b* to which the pre-wash water supply passage 366 is connected. The main-wash water supply passage connecting portion 363*a* and the pre-wash water supply passage connecting portion 363*b* protrude rearward to be inclined in different directions. For example, the main-wash water supply passage connecting portion 363*a* is disposed to be inclined to a rear right side of the distribution unit body 362 in the drawing, and the pre-wash water supply passage connecting portion 363*b* is disposed to be inclined to a rear left side of the distribution unit body 362 in the drawing.

The plurality of wash water movement paths 390 include a main valve supply portion 391 through which wash water is supplied when the main valve 369 is opened. The main valve supply portion 391 is connected to the main-wash water supply passage connecting portion 363*a*. The main valve supply portion 391 is mainly formed in a left region of the distribution unit body 362 in the drawing, for example. The main valve supply portion 391 is provided with a plurality of distribution holes 392 formed through a bottom surface thereof. A hot water supply portion 375 for supplying hot water may be connected to one side of the main valve supply portion 391, for example.

The plurality of wash water movement paths 390 include a pre-valve supply portion 395 through which wash water is supplied when the pre-valve 370 is opened. The pre-valve supply portion 395 is connected to the pre-wash water supply passage connecting portion 363*b*. The pre-valve supply portion 395 is formed in a right front region of the distribution unit body 362 in the drawing. The pre-valve supply portion 395 is provided with a plurality of distribution holes 397 formed through a bottom surface thereof.

On the other hand, a main-pre valve supply portion 399 for supplying wash water when the main valve 369 and the pre-vale 370 are simultaneously opened is provided between the main valve supply portion 391 and the pre-valve supply portion 395. A distribution hole 401 is formed through a bottom surface of the main-pre valve supply portion 399. The distribution hole 401 is formed at a position where wash water may fall down into the fabric softener storage portion 318.

Figure 5:
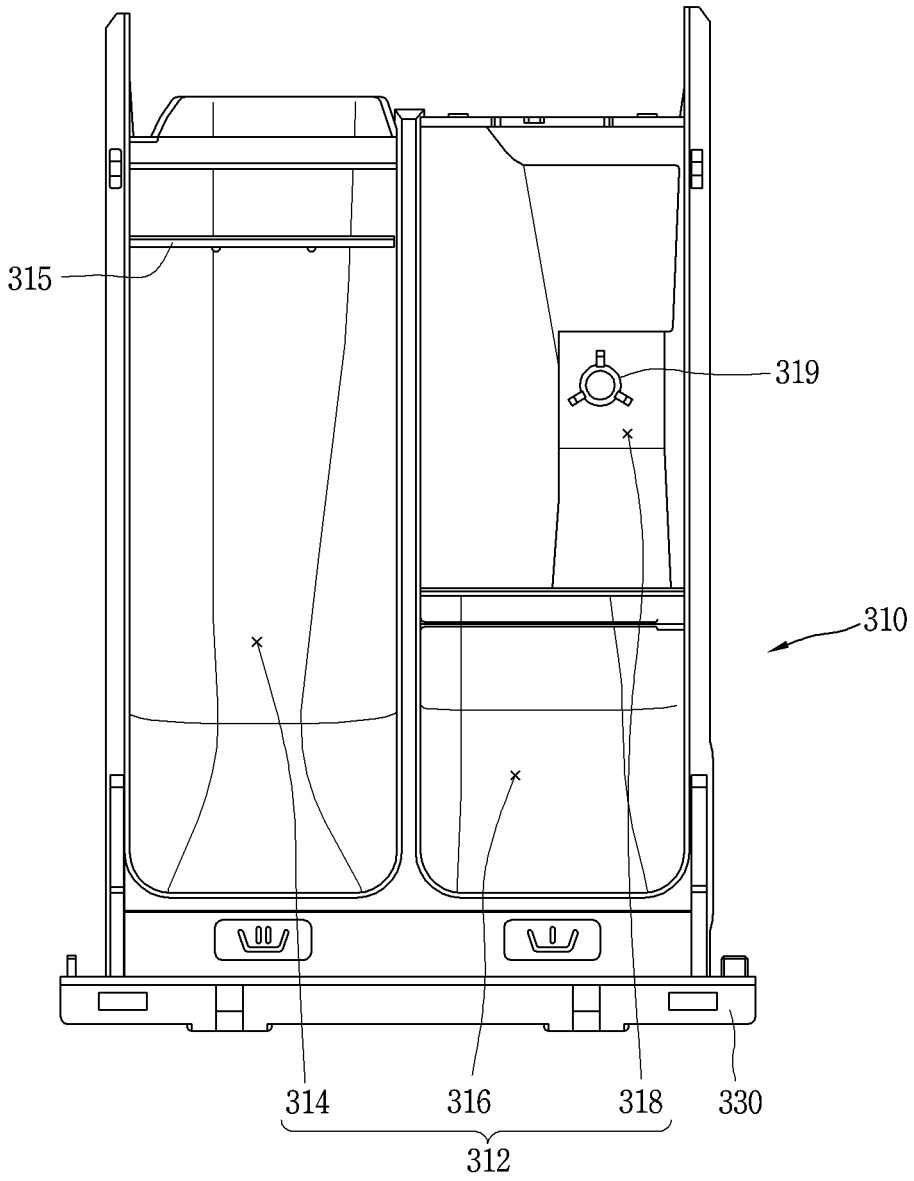
FIG. 5 is a planar view of a drawer of FIG. 3.

FIG. 5 is a planar view of the drawer 310 of FIG. 3. As illustrated in FIG. 5, the plurality of detergent storage spaces 312 is formed in the drawer 310. The plurality of detergent storage spaces 312 includes the main detergent storage portion 314 in which detergent to be used during main-wash is stored (accommodated). The plurality of detergent storage spaces 312 includes a pre-detergent storage portion 316 in which detergent to be used during pre-wash is stored. The plurality of detergent storage spaces 312 includes a fabric softener storage portion 318 in which fabric softener to be used during a rinsing stroke is stored.

The main detergent storage portion 314 is formed at, for example, a left region inside the drawer 310. The pre-detergent storage portion 316 is formed at a right front region inside the drawer 310. The fabric softener storage portion 318 is formed at a right rear region inside the drawer 310.

The main detergent storage portion 314 may be inclined rearward so that wash water passed through the main valve supply portion 391 can be moved backward with detergent. A barrier 315 is provided at a rear region of the main detergent storage portion 314. The barrier 315 applies resistance to detergent stored in the main detergent storage portion 314 so that the detergent can move backward slowly, not at a time. A through portion 315*a* may be formed through the barrier 315 to allow an appropriate amount of detergent and wash water to pass therethrough. For example, the through portion 315*a* may be formed such that a center of the barrier 315 is blocked and both side regions or one side region of the barrier 315 are(is) penetrated.

The pre-detergent storage portion 316 may be inclined rearward so that wash water passed through the pre-valve supply portion 395 can be moved backward with detergent.

The fabric softener storage portion 318 is located at the rear of the pre-detergent storage portion 316. The fabric softener storage portion 318 is provided with an outlet tube 319 to allow the fabric softener to flow downward out of the fabric detergent storage space 318. The outlet tube 319 protrudes upward from a bottom surface of the fabric softener storage portion 318. The outlet tube 319 is coupled to a tubular portion 323 of the siphon generating member 321. The outlet tube 391 is accommodated in the tubular portion 323, so that a movement path for fabric softener is formed between an inner surface of the tubular portion 323 and an outer surface of the outlet tube 319. The tubular portion 323 is spaced apart from the bottom of the fabric softener storage portion 318 by a preset distance so that the fabric softener can be introduced. When a water level of fabric softener in the fabric softener storage portion 318 rises above a height of the outlet tube 319, the fabric softener starts to flow out. When the fabric softener starts to flow out, even if the water level of the fabric softener is lower than the height of the outlet tube 319 due to the siphon phenomenon, the fabric softener can continue to flow out.

Figure 6:
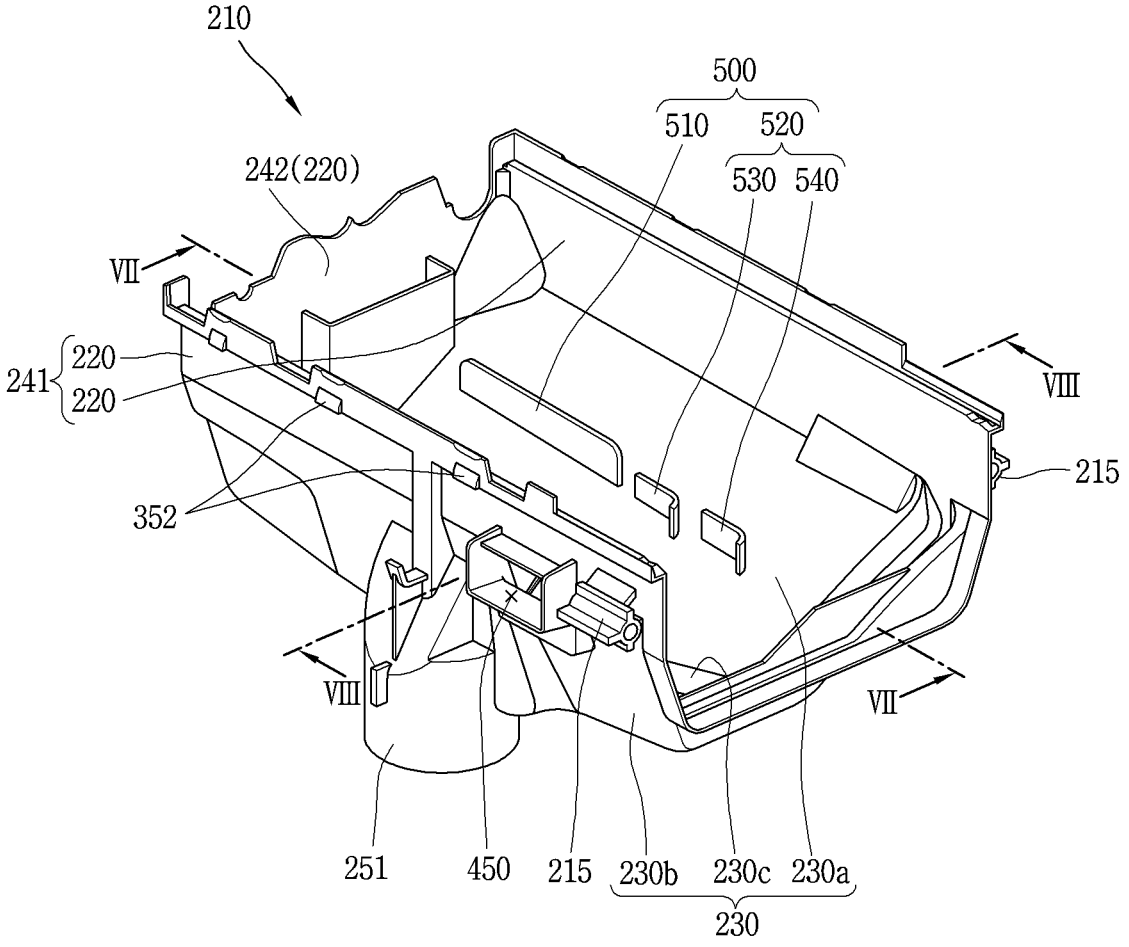
FIG. 6 is a perspective of a housing of FIG. 3.
Figure 7:
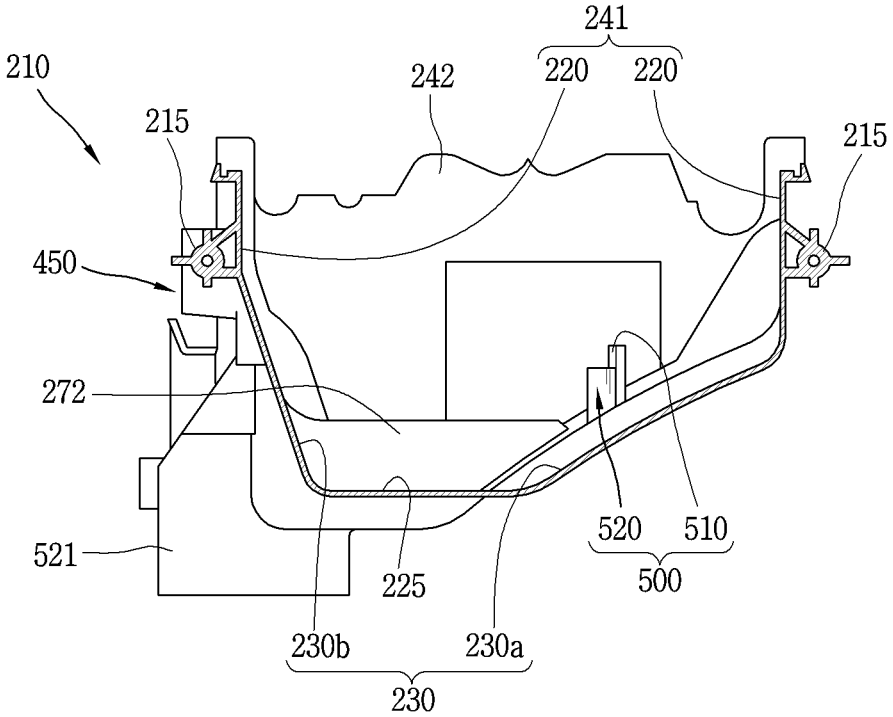
FIG. 7 is a cross-sectional view taken along the line VII-VII of FIG. 6.
Figure 8:
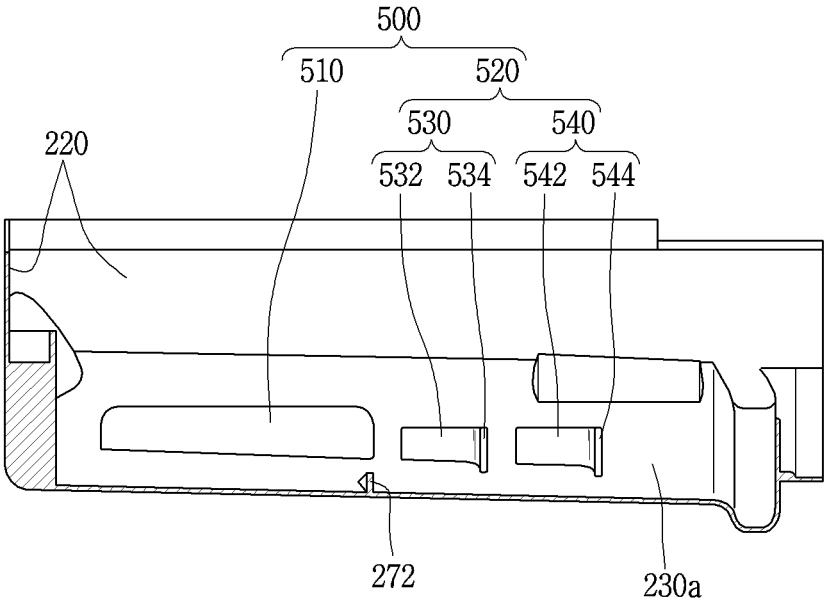
FIG. 8 is a cross-sectional view taken along the line VIII-VIII of FIG. 6.

FIG. 6 is a perspective of a housing of FIG. 3, FIG. 7 is a cross-sectional view taken along the line VII-VII of FIG. 6, and FIG. 8 is a cross-sectional view taken along the line VIII-VIII of FIG. 6. As illustrated in FIGS. 6 and 7, the housing 210 has a shape with upper and lower openings. The housing 210 is disposed at an inner side of a front plate 110*a* of the cabinet 110. Screw coupling portions 215 to be coupled with screws are formed on front regions of outer surfaces of both side portions 241 of the housing 210.

The housing 210 includes a plurality of vertical (longitudinal) sections 220 for accommodating the drawer 310, a horizontal section 225 formed below the drawer 310, and a plurality of inclined sections 230. The plurality of vertical sections 220 is disposed at both sides and the rear side of the drawer 310, respectively. The horizontal section 225 and the plurality of inclined sections 230 are formed at the lower side of the drawer 310, respectively.

The housing 210 includes both side portions 241 disposed at both sides of the drawer 310, a rear portion 242 disposed at the rear of the drawer 310, and a bottom surface disposed below the drawer 310.

The both side portions 241 include the vertical sections 220 disposed at the both sides of the drawer 310, respectively.

The rear portion 242 includes the vertical section 220 disposed at the rear side of the drawer 310.

The bottom portion 245 includes the horizontal section 225 and the plurality of inclined sections 230.

The bottom portion 245 has a through portion 247 formed therethrough to allow wash water to flow out. The through portion 247 may be formed through the horizontal section 225. Here, the horizontal section 225 may also be slightly inclined toward the through portion 247 (for example, having a small inclination relative to the inclined section 230). The plurality of inclined sections 230 may be inclined toward the through portion 247. As a result, wash water inside the housing 210 may be smoothly moved toward the through portion 247. If a movement (speed) of wash water along the plurality of inclined sections 230 is too slow due to small inclinations of the plurality of inclined sections 230, transfer performance of detergent is lowered. On the other hand, if the movement of the wash water is too fast due to large inclinations of the plurality of inclined sections 230, a distance by which the wash water moves over the through portion 247 increases. Therefore, those cases are not preferable. The plurality of inclined sections 230 may be configured to have preset inclinations, respectively, in consideration of those cases.

The through portion 247 may be formed at one side (left side in the drawing) of the horizontal section 225. The through portion 247 may alternatively protrude to outside of the housing 210. A wash water supply tube 260 may be provided such that one end portion thereof is connected to the water tub 140 and another end portion is connected to the through portion 247 (see FIG. 2). Accordingly, the inside of the water tub 140 and the inside of the housing 210 may communicate with each other. The through portion 247 may be provided with a wash water supply tube connecting portion 251 to which the wash water supply tube 260 is connected.

A ventilation portion 450 is formed through one side surface (left surface in the drawing, for example) of the housing 210 so that the inside and outside of the housing 210 can communicate with each other. As a result, the inside of the water tub 140 communicates with the outside of the housing 210. With this configuration, when the door 115 is closed after a baby or an animal has entered the drum 160 through the front opening of the cabinet 110, the baby or the animal inside the drum 160 can breathe through the wash water supply tube 260 and the ventilation portion 450.

The plurality of inclined sections 230 may include a first inclined section (right inclined section) 230*a* and a second inclined section (left inclined section) 230*b* which are downwardly inclined from the both side portions 241 of the housing 210 to the inside of the housing 210, a third inclined section (front inclined section) 230*c* disposed at the front of the through portion 247, and a fourth inclined section (rear inclined section) 230*d* disposed at the rear of the through portion 247.

Here, the first inclined section 230*a* and the second inclined section 230*b* may be configured to have different inclination angles (inclinations) with respect to the horizontal section 225. The first inclined section 230*a* and the second inclined section 230*b* are inclined inwards along left and right directions of the housing 210, respectively. The second inclined section 230*b* may have a larger inclination angle than the first inclined section 230*a* and may be relatively nearly-longitudinal. The first inclined section 230*a* is a section in which a wash water movement path is formed, and has a relatively low (small) inclination. The third inclined section 230*c* and the fourth inclined section 230*d* are inclined along the back and forth directions of the housing 210, respectively. The third inclined section 230*c* is downwardly inclined toward the through portion 247 located at its rear side. The fourth inclined section 230*d* is downwardly inclined toward the through portion 247 located at its front side.

On the other hand, the bottom portion 245 of the housing 210 is configured such that wash water falling down to the inner rear region of the housing 210 together with detergent can be smoothly moved toward the through portion 247 so as to be supplied into the water tub 140. The bottom portion 245 of the housing 210 is provided with the plurality of inclined sections 230 so that wash water can have an appropriate moving speed.

The bottom portion 245 of the housing 210 is provided with a horizontal partition 272 protruding above the through portion 247 and disposed in the left and right directions of the housing 210. Accordingly, wash water dropped to the inner rear region of the housing 210 can be suppressed from excessively moving to an inner front region of the housing 210 over the through portion 247 of the housing 210. When the wash water moved together with the detergent is excessively moved forward of the housing 210, the detergent moved forward is more highly likely to remain at the inner front region of the housing 210. More specifically, since the detergent moved to the inner front region of the housing 210 is relatively difficult to be removed, the possibility that the detergent remaining thereat increases. For example, when only the horizontal partition 272 is provided inside the housing 210, wash water and part of detergent which have moved forward of the horizontal partition 272 due to overflow caused by an increase in water level in the housing 210 are discharged through the through portion 247 but other part of the detergent moved to the inner front region of the housing 210 together with the wash water mostly remains at the inner front region of the housing 210. In order to remove the detergent, it is needed to form a movement path of wash water to a front region of the horizontal partition 272.

The horizontal partition 272 is located lower than the ventilation portion 450. Accordingly, when a level of wash water in the housing 210 rises, the wash water can move to the front region of the horizontal partition 272 over the horizontal partition 272 without being discharged to outside of the housing 210 through the ventilation portion 450, thereby preventing an excessive increase in the water level of housing 210.

The horizontal partition 272 is formed at a point moved forward by a preset distance from a center of the through portion 247 in the back and forth direction of the housing 210. An amount of wash water and detergent introduced into the through portion 247 may be controlled by the horizontal partition 272. More specifically, the horizontal partition 272 may be formed at a point where it divides an inner space of the through portion 247 at a preset ratio (for example, about 70:30). Accordingly, wash water dropped via the main detergent storage portion 314 is mostly supplied to the water tub 140 by the horizontal partition 272 through the rear region of the inner space of the through portion 247. When pressure of wash water passed through the main detergent storage portion 314 is abnormally (unusually) increased and thereby a flow rate is excessively increased to raise a water level, the detergent and wash water may be moved to the front region of the horizontal partition 272 over the horizontal partition 272. The detergent and wash water moved to the front region of the horizontal partition 272 may be supplied to the water tub 140 through the inner front region of the through portion 247 located at the front of the horizontal partition 272.

The horizontal partition 272 includes a first section disposed above the through portion 247, and a second section 272*b* extending from the first section 272*a* so as to be located in the second inclined section 230*b*. The first section 272*a* is disposed in the left and right directions of the housing 210. The second section 272*b* is disposed to be inclined rearward in the left and right directions of the housing 210. The second section 272*b* may have an inclination angle of about 30 to 40 degrees with respect to the housing 210 (see FIG. 11).

The housing 210 is provided with a wash water guide unit 500 for guiding wash water such that a plurality of wash water movement paths is formed at the front region of the horizontal partition 272. Accordingly, detergent remaining at the front region of the horizontal partition 272 is washed out by the wash water flowing along the wash water movement paths formed at the front region of the horizontal partition 272, thereby suppressing detergent residue on the inner front region of the housing 210.

The wash water guide unit 500 may include a vertical partition 510 protruding at one side of the horizontal partition 272 and disposed in the back and forth direction of the housing 210, and an extension partition 520 formed at the front of the vertical partition 510 with being spaced apart from the vertical partition 510.

The vertical partition 510 protrudes upward in the first inclined section 230*a*. The vertical partition 510 has a substantially rectangular plate shape. The vertical partition 510 is spaced forwardly apart from the rear portion 242 of the housing 210 by a preset distance. Accordingly, a part of wash water dropped via the pre-detergent storage portion 316 may be moved to the rear region of the horizontal partition 272 between the rear portion 242 and a rear end portion of the vertical partition 510.

The extension partition 520 has a substantially rectangular plate shape. The extension partition 520 is formed at the front of the vertical partition 510 with being spaced a preset distance apart from the vertical partition 510. As a result, another part of the wash water dropped via the pre-detergent storage portion 316 is moved downward between the vertical partition 510 and the extension partition 520. In addition, still another part of the wash water dropped via the pre-detergent storage portion 316 is moved forward of the extension partition 520 so as to be moved downward. As a result, the wash water dropped via the pre-detergent storage portion 316 is moved to the front region of the horizontal partition 272 along the two movement paths.

The wash water dropped via the pre-detergent storage portion 316 is partially moved along the vertical partition 510, partially moved downward between the vertical partition 510 and the extension partition 520 to form a first movement path toward the horizontal partition 272, and also partially moved downward after moved forward of the housing 210 along the extension partition 520 so as to form a second movement path toward the horizontal partition 272 via the front region of the housing 210. As a result, the detergent remaining at the front region of the horizontal partition 272 can be effectively washed out, and thus the detergent residue on the inner front region of the housing 210 can be suppressed.

The extension partition 520 includes a first extension partition 530 formed at one side of the vertical partition 510 and a second extension partition disposed at the front the first extension partition 530 in a spaced manner. As a result, the wash water dropped via the pre-detergent storage portion 316 forms the plurality of wash water movement paths at the front of the horizontal partition 272. This may result in suppressing the detergent residue at the front region of the horizontal partition 272.

More specifically, the first extension partition 530 includes a first extension partition body 532 and a first bent end portion 534 bent from the first extension partition body 532. The first extension partition body 532 is disposed along the back and forth direction of the housing 210. The first bent end portion 534 is bent from a front end of the first extension partition body 532. Wash water moved along the first extension partition body 532 may be guided by the first bent end portion 534 to be stably moved downward.

The second extension partition 540 includes a second extension partition body 542 and a second bent end portion 544 bent from the second extension partition body 542. The second extension partition body 542 is disposed along the back and forth direction of the housing 210. The second bent end portion 544 is bent from a front end of the second extension partition body 542. Wash water moved along the second extension partition body 542 may be guided by the second bent end portion 544 to be stably moved downward.

Here, the extension partition 520 may be configured to have a relatively lower height than the vertical partition 510. This is because some of the wash water dropped via the pre-detergent storage portion 316 have already been moved along both sides of the vertical partition 510 and thus the extension partition 520 guides a relatively reduced amount of wash water.

Hereinafter, a flow of wash water through the distribution unit 360 will be described with reference to FIGS. 9 to 14.

Figure 9:
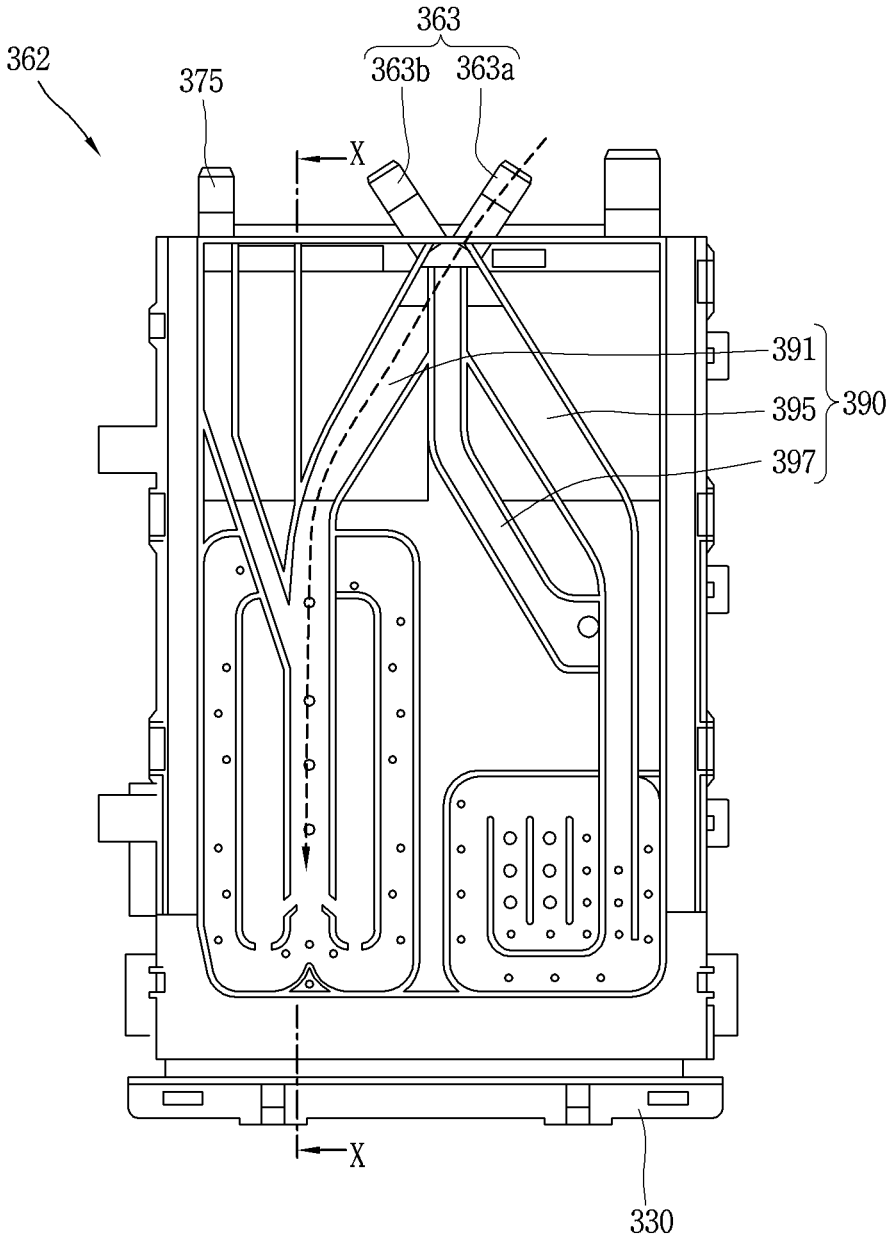
FIG. 9 is a view illustrating an operation of a main valve supply portion of the distribution unit body of FIG. 4.
Figure 10:
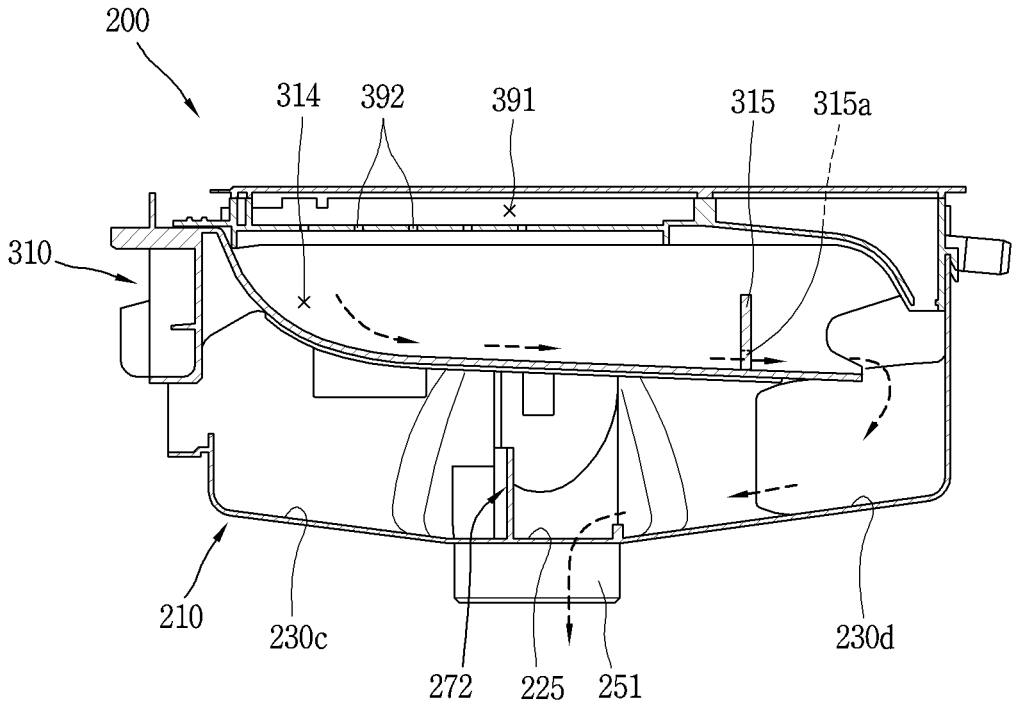
FIG. 10 is a cross-sectional view taken along the line X-X of FIG. 9.
Figure 11:
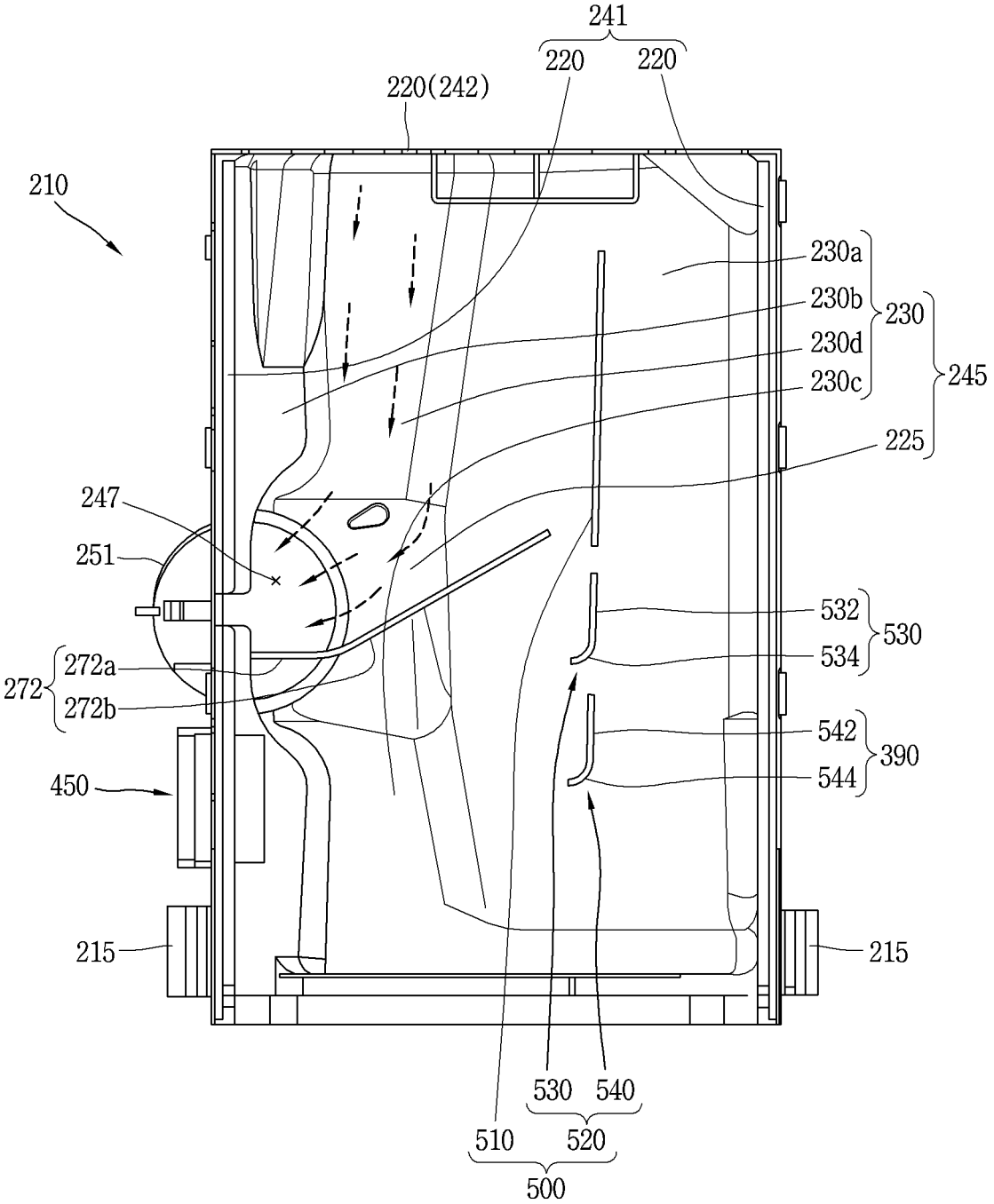
FIG. 11 is a view illustrating a flow of wash water passing through the main valve supply portion of FIG. 9.

FIG. 9 is a view illustrating an operation of the main valve supply portion 391 of the distribution unit body 362 of FIG. 4, FIG. 10 is a cross-sectional view taken along the line X-X of FIG. 9, and FIG. 11 is a view illustrating a flow of wash water passing through the main valve supply portion 391 of FIG. 9.

As illustrated in FIG. 9, when the main valve 369 is opened to open the main-wash water supply passage 365, wash water is moved into the main valve supply portion 391, and then dropped into the main detergent storage portion 314 of the drawer 310 through the distribution holes 392.

As illustrated in FIG. 10, the wash water passed through the main valve supply portion 391 is moved into the rear region of the main detergent storage portion 314 of the drawer 310, and thus dropped into the rear left region of the housing 210 in the drawing.

The wash water dropped to the rear of the housing 210 via the main detergent storage portion 314 of the drawer 310, as illustrated in FIG. 11, flows along the fourth inclined section 230*d* (rear inclined section) to be moved into the water tub 140 via the rear region of the through portion 247.

The horizontal partition 272 prevents the detergent and the wash water moved forward along the fourth inclined section 230*d* from being moved to the front region of the housing 210, thereby suppressing the detergent from remaining in the housing 210.

Figure 12:
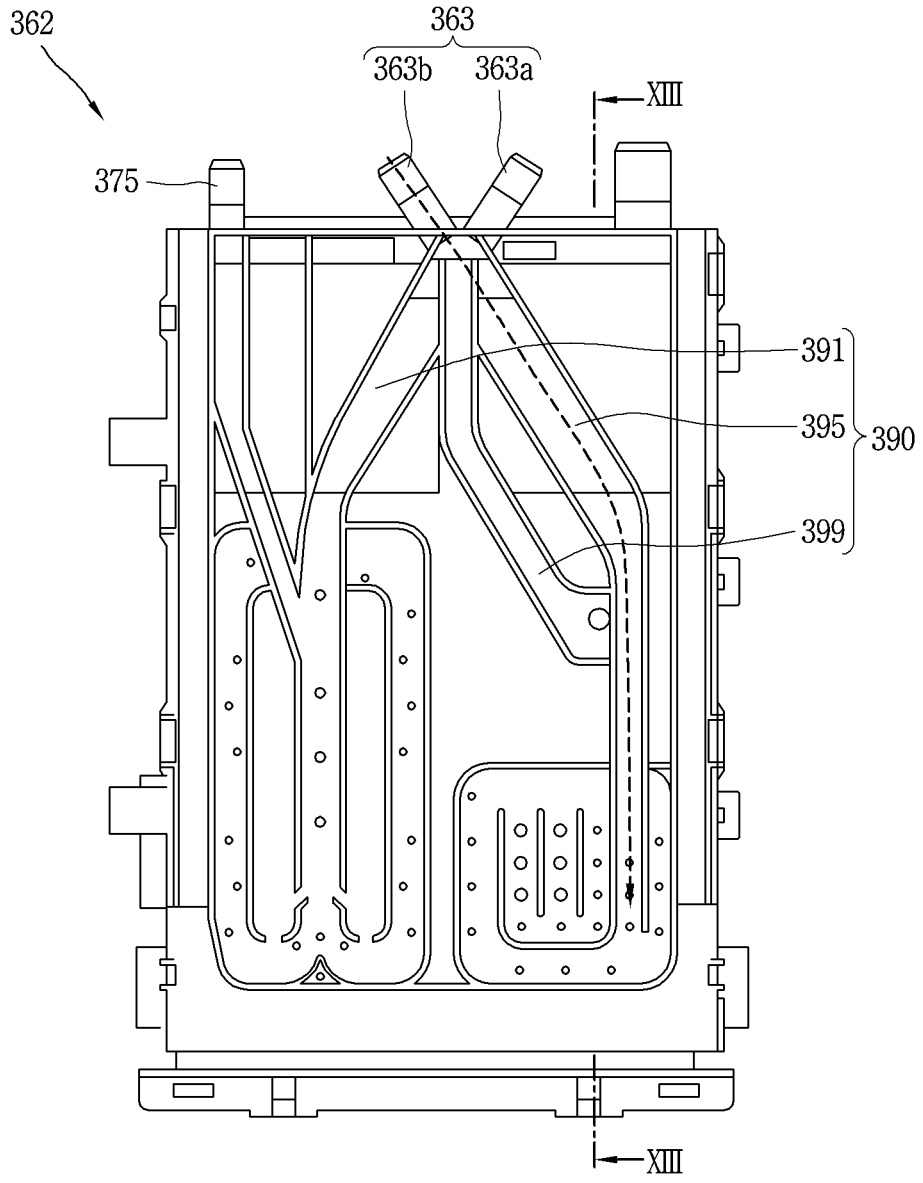
FIG. 12 is a view illustrating an operation of a pre-valve supply portion of the distribution unit body of FIG. 4.
Figure 13:
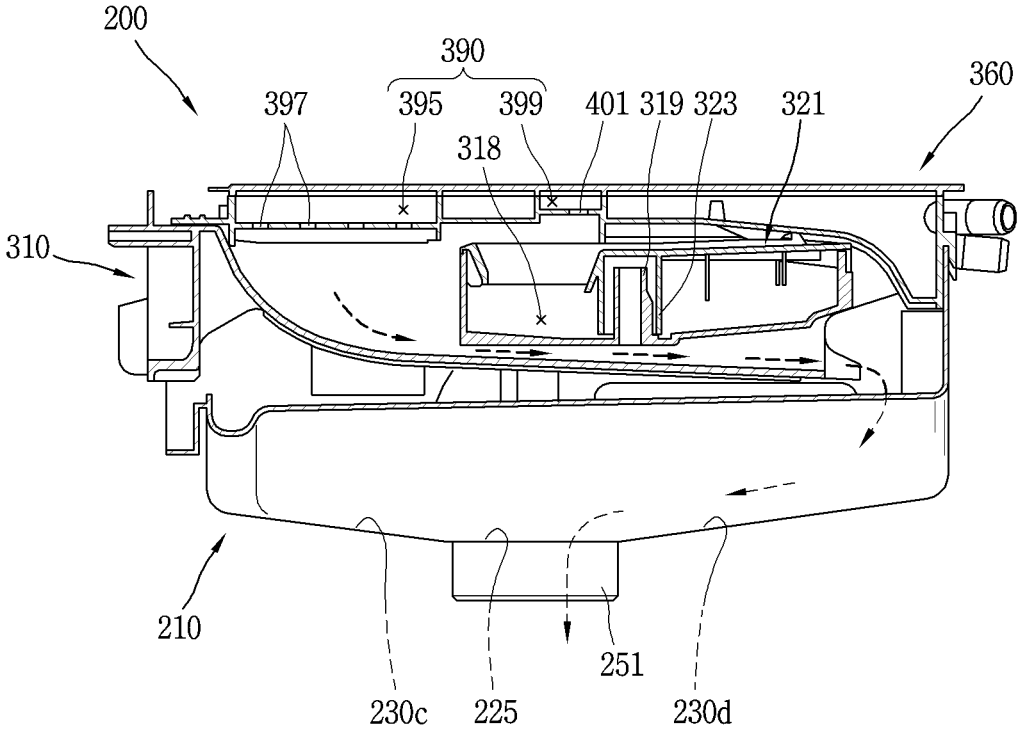
FIG. 13 is a cross-sectional view taken along the line XIII-XIII of FIG. 12.
Figure 14:
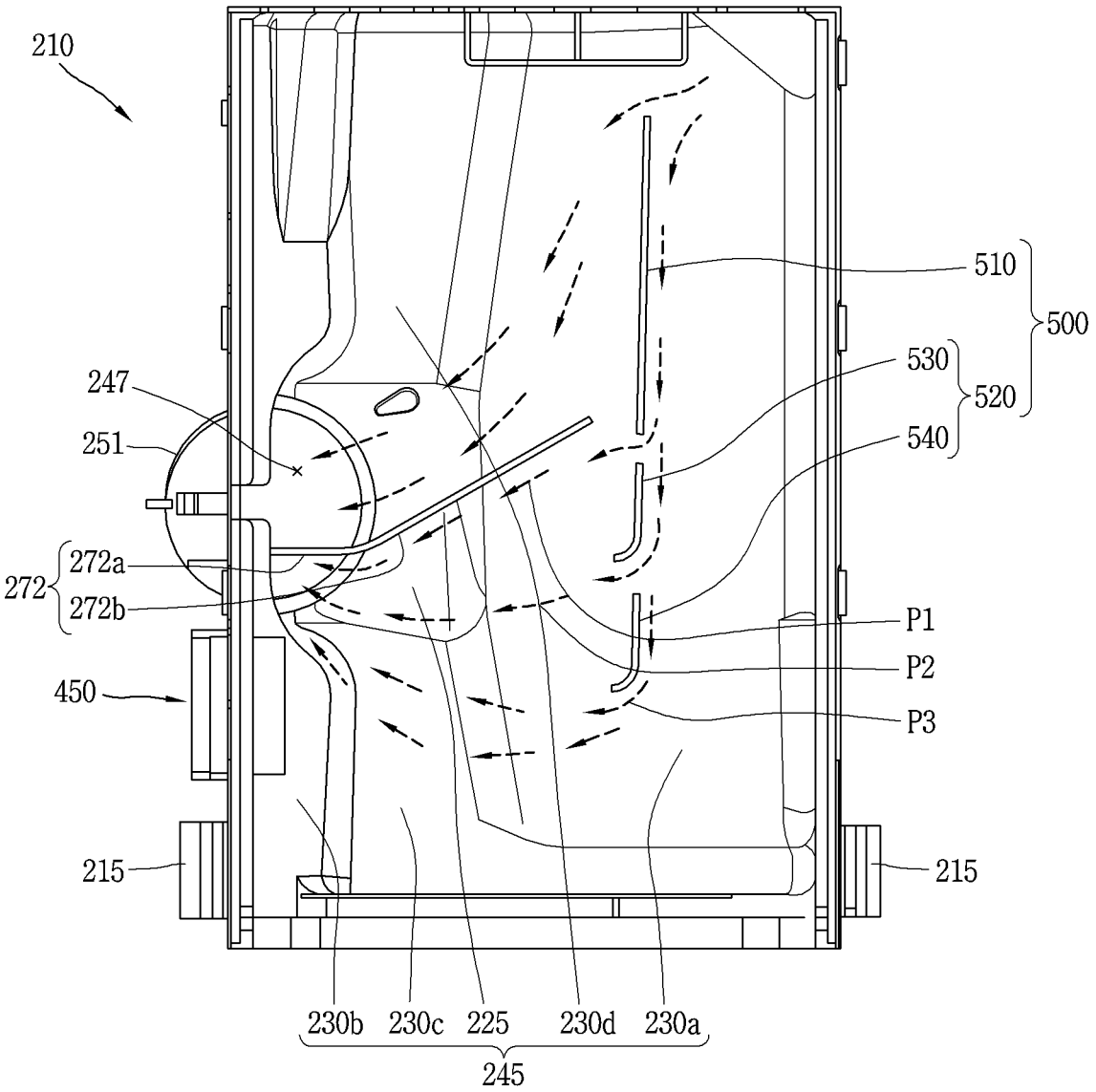
FIG. 14 is a view illustrating a flow of wash water passing through the pre-valve supply portion of FIG. 12.

FIG. 12 is a view illustrating an operation of the pre-valve supply portion 395 of the distribution unit body 362 of FIG. 4, FIG. 13 is a cross-sectional view taken along the line XIII-XIII of FIG. 12, and FIG. 14 is a view illustrating a flow of wash water passing through the pre-valve supply portion 395 of FIG. 12. As illustrated in FIG. 12, when the pre-valve 370 is opened, wash water is moved along the pre-wash water supply passage 366 and then flows into the pre-valve supply portion 395 inside the distribution unit 360. The wash water moved to the pre-valve supply portion 395 is dropped into the drawer 310 through the distribution holes 397 formed through the bottom surface of the pre-valve supply portion 395.

The wash water passed through the pre-valve supply portion 395 is dropped into the pre-detergent storage portion 316 of the drawer 310. As illustrated in FIG. 13, the wash water dropped to the pre-detergent storage portion 316 is moved to the rear region of the pre-detergent storage portion 316 and dropped into the rear region of the housing 210. The wash water dropped via the pre-detergent storage portion 316 is dropped into the rear right region (first inclined section 230*a*) of the housing 210.

As illustrated in FIG. 14, the wash water dropped down to the rear of the housing 210 via the pre-detergent storage portion 316 is partially moved downward between the rear portion 242 of the housing 210 and the rear end portion of the vertical partition 510, so as to be introduced into the rear region of the horizontal partition 272. The wash water introduced to the rear of the horizontal partition 272 is supplied into the water tub 140 through the rear region of the through portion 247.

Part of the wash water dropped via the pre-detergent storage portion 316 is moved forward along the vertical partition 510. Part of the wash water moved along the vertical partition 510 is moved downward between the vertical partition 510 and the first extension partition 530, so as to form a first path P1 along the front region of the horizontal partition 272. Another part of the wash water moved along the vertical partition 510 is moved along the first extension partition 530, and then moved downward between the first extension partition 530 and the second extension partition 540, so as to form a second path P2 formed via a front region of the first path P1. In addition, another part of the wash water moved along the first extension partition 530 is moved to the front region of the second extension partition 540 and then moved downward, so as to form a third path P3 formed via the front region of the housing 210, namely, a front region of the second path P2.

Accordingly, the detergent remaining at the front of the horizontal partition 272 is washed off by the wash water moved along the first path P1, the second path P2, and the third path P3, thereby suppressing the detergent from remaining at the inner front region of the housing 210. In this exemplary embodiment, the first path P1, the second path P2, and the third path P3 are illustrated with arrows, respectively, but it will be understood that the first path P1, the second path P2, and the third path P3 are not formed to exactly coincide with the arrows shown in the drawing.

Hereinafter, a laundry treating apparatus according to another embodiment disclosed herein will be described with reference to FIGS. 15 to 27.

Figure 15:
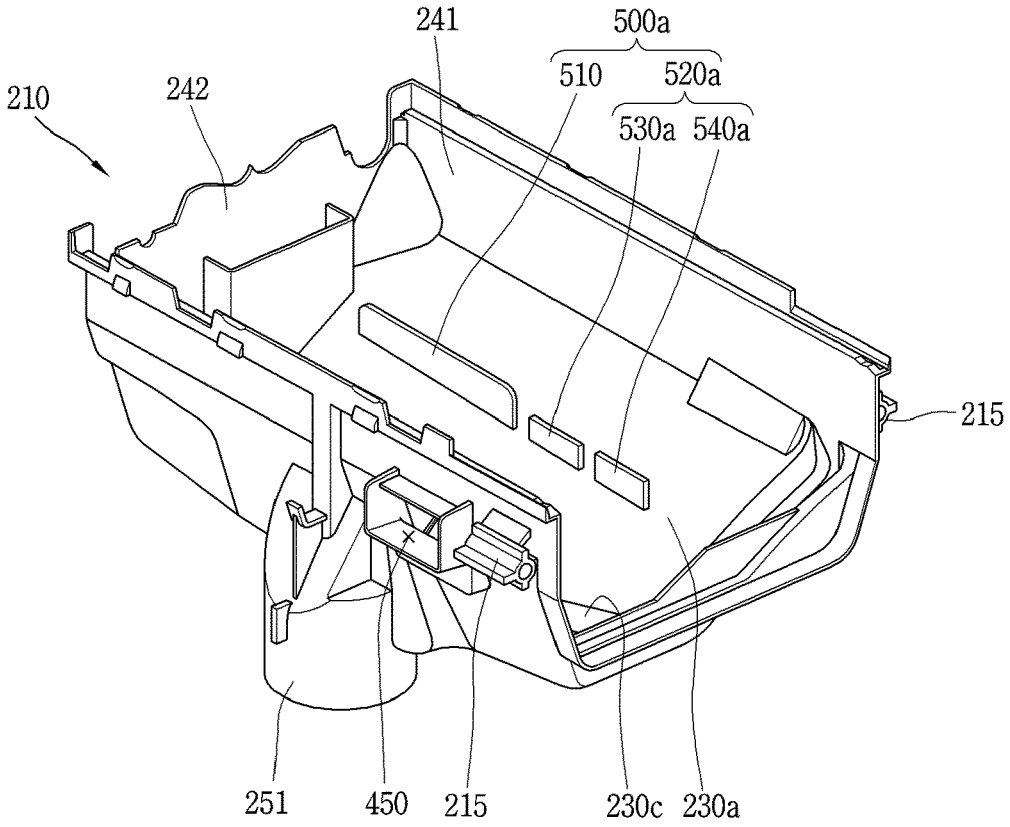
FIG. 15 is a perspective view of a housing of a laundry treating apparatus in accordance with another embodiment.
Figure 16:
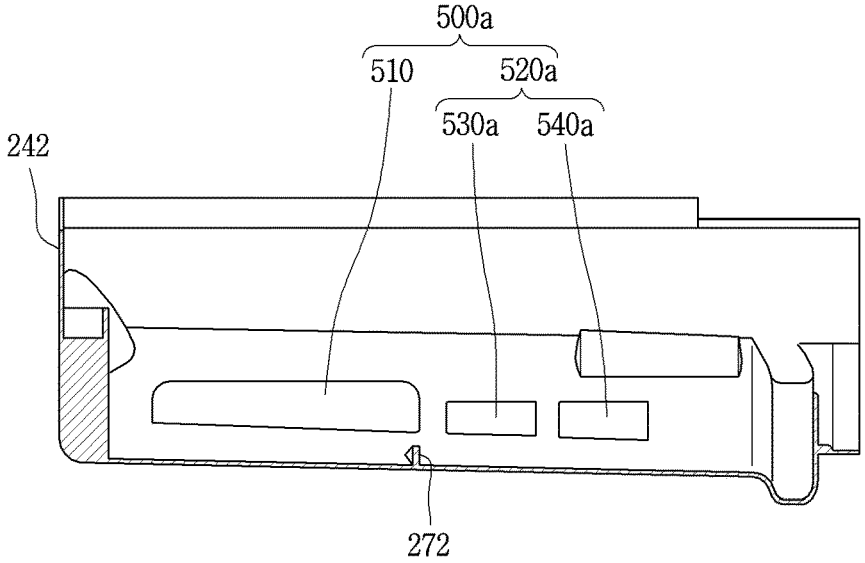
FIG. 16 is a partial cross-sectional view illustrating a wash water guide unit of FIG. 15.
Figure 17:
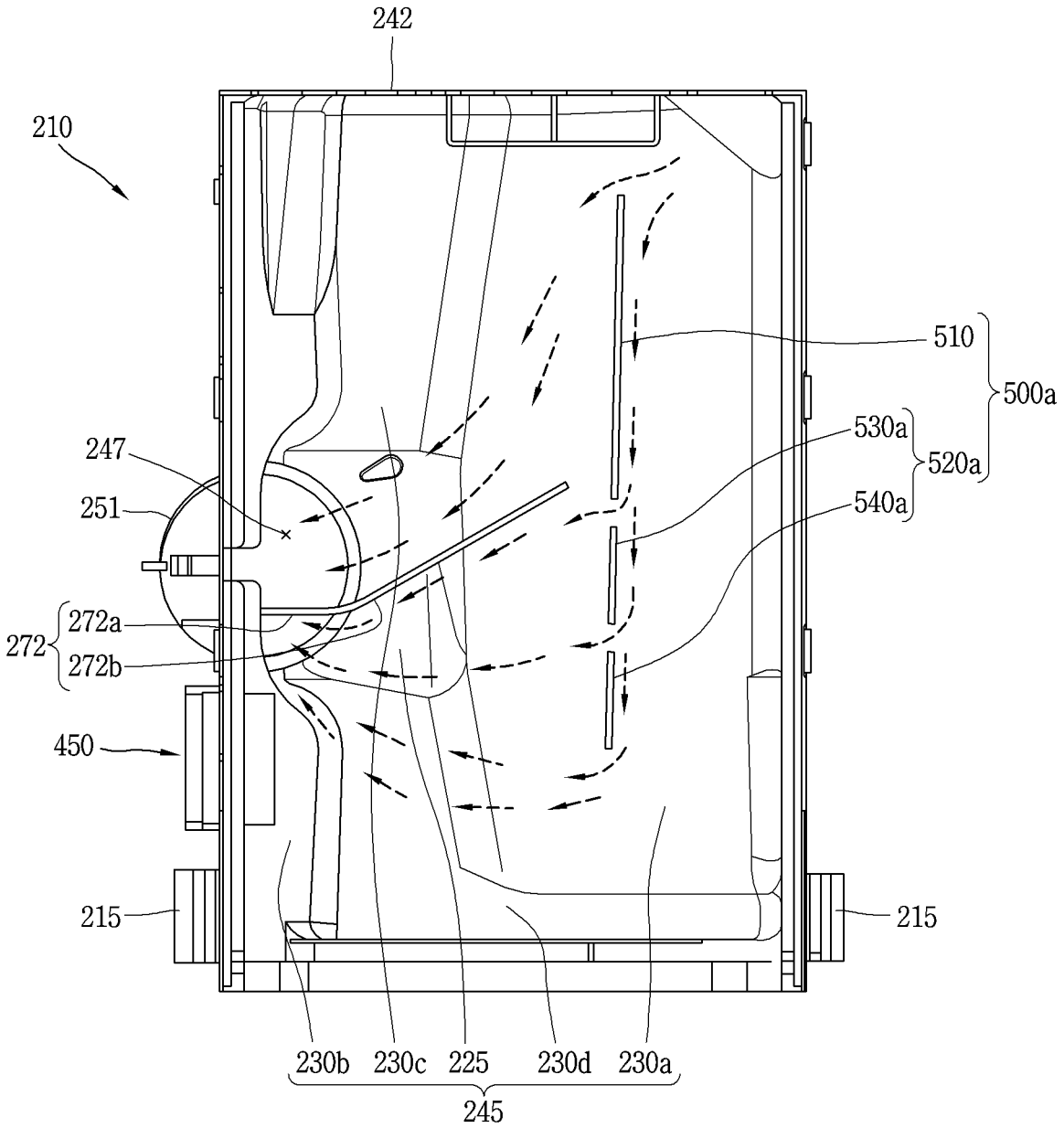
FIG. 17 is a view illustrating an operation of the wash water guide unit of FIG. 16.

FIG. 15 is a perspective view of a housing 210 of a laundry treating apparatus in accordance with another embodiment, FIG. 16 is a partial cross-sectional view illustrating a wash water guide unit 500*a* of FIG. 15, and FIG. 17 is a view illustrating an operation of the wash water guide unit 500*a* of FIG. 16. As illustrated in FIGS. 15 and 16, a housing 210 of a laundry treating apparatus according to this embodiment, as aforementioned, has a shape with upper and front openings. A bottom portion 245 of the housing 210 may include a through portion 247 communicating with the water tub 140, and a plurality of inclined sections 230 inclined to allow wash water to be moved toward the through portion 247.

A horizontal partition 272 is provided above the through portion 247.

A wash water guide unit 500*a* according to one embodiment disclosed herein is provided at one side of the horizontal partition 272.

The wash water guide unit 500*a* may include a vertical partition 510 protruding at one side of the horizontal partition 272 and disposed in the back and forth direction of the horizontal partition 272, and an extension partition 520*a* formed at the front of the vertical partition 510 with being spaced apart from the vertical partition 510. The vertical partition 510 has a substantially rectangular plate shape.

The extension partition 520*a* includes a first extension partition 530*a* formed at the front of the vertical partition 510 in a spaced manner, and a second extension partition 540*a* formed at the front of the first extension partition 530*a* in a spaced manner.

The first extension partition 530*a* and the second extension partition 540*a* each have a rectangular plate shape.

The first extension partition 530*a* and the second extension partition 540*a* are formed to have a relatively lower height than the vertical partition 510.

Accordingly, part of wash water dropped via the pre-detergent storage portion 316 is moved to the rear region of the horizontal partition 272 between the horizontal partition 510 and the rear portion 242.

Another part of the wash water dropped via the pre-detergent storage portion 316 is moved along the vertical partition 510, and then moved downward through between the vertical partition 510 and the first extension partition 530*a*, so as to form a first path P1 along the front region of the horizontal partition 272. Still another part of the wash water moved along the vertical partition 510 is moved along the first extension partition 530*a*, and then moved downward through between the first extension partition 530*a* and the second extension partition 540*a*, so as to form a second path P2. Still another part of the wash water moved along the first extension partition 530*a* is moved along the second extension partition 540*a*, and then moved along the forefront region of the housing 210, so as to form a third path P3. Accordingly, the detergent remaining at the inner front region of the housing 210 can be washed out by the wash water moving along the plurality of wash water movement paths, thereby suppressing the detergent from remaining at the inner front region of the housing 210.

Figure 18:
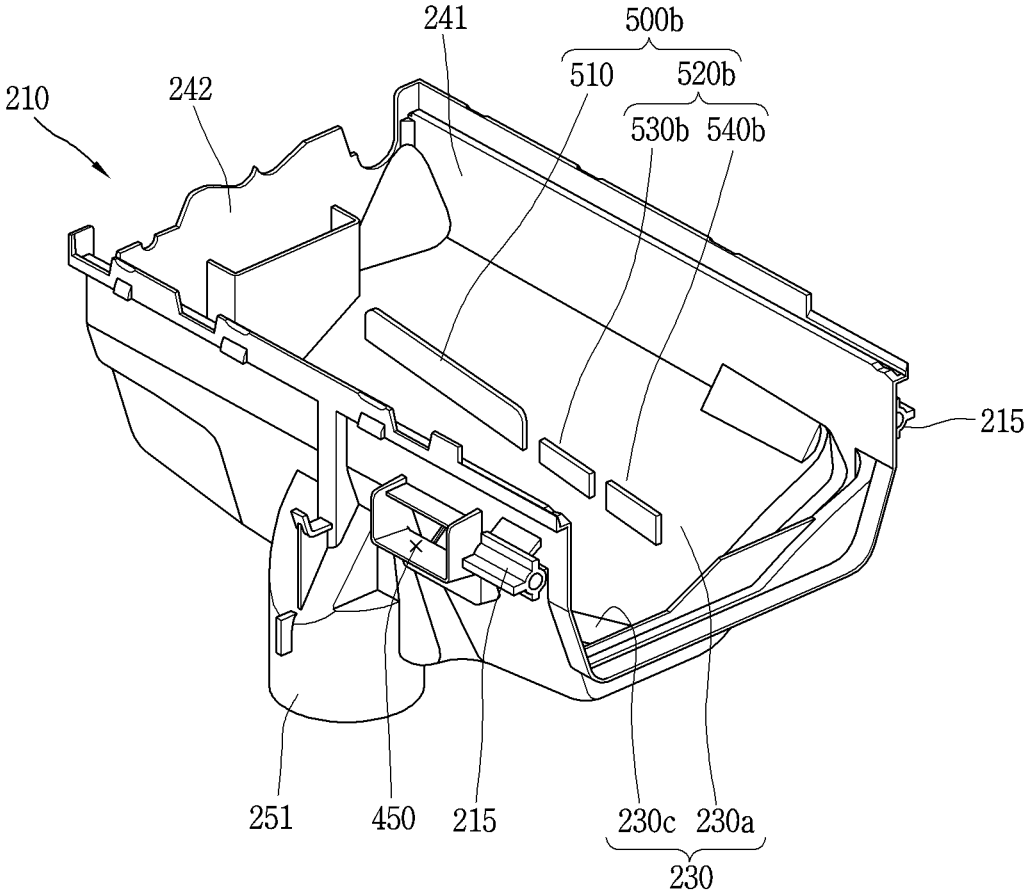
FIG. 18 is a perspective view of a housing of a laundry treating apparatus in accordance with another embodiment.
Figure 19:
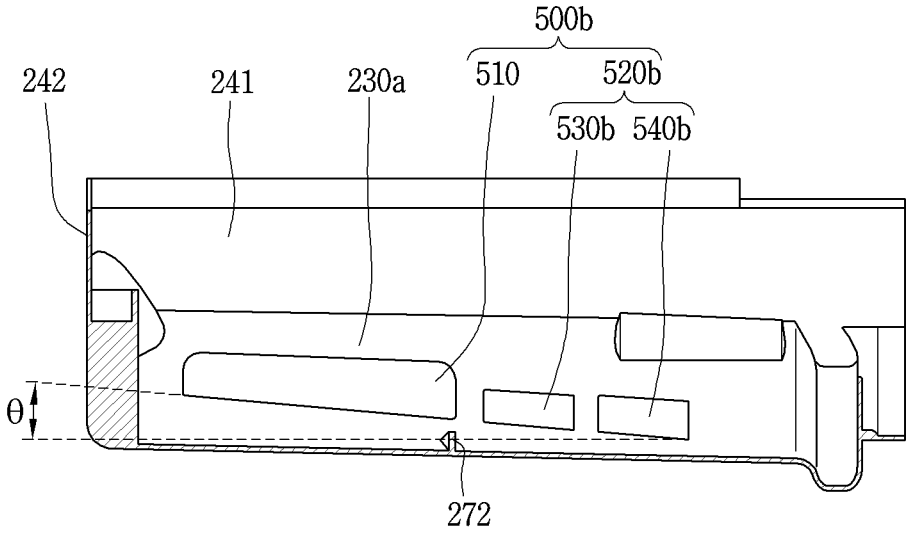
FIG. 19 is a partial cross-sectional view illustrating a wash water guide unit of FIG. 18.
Figure 20:
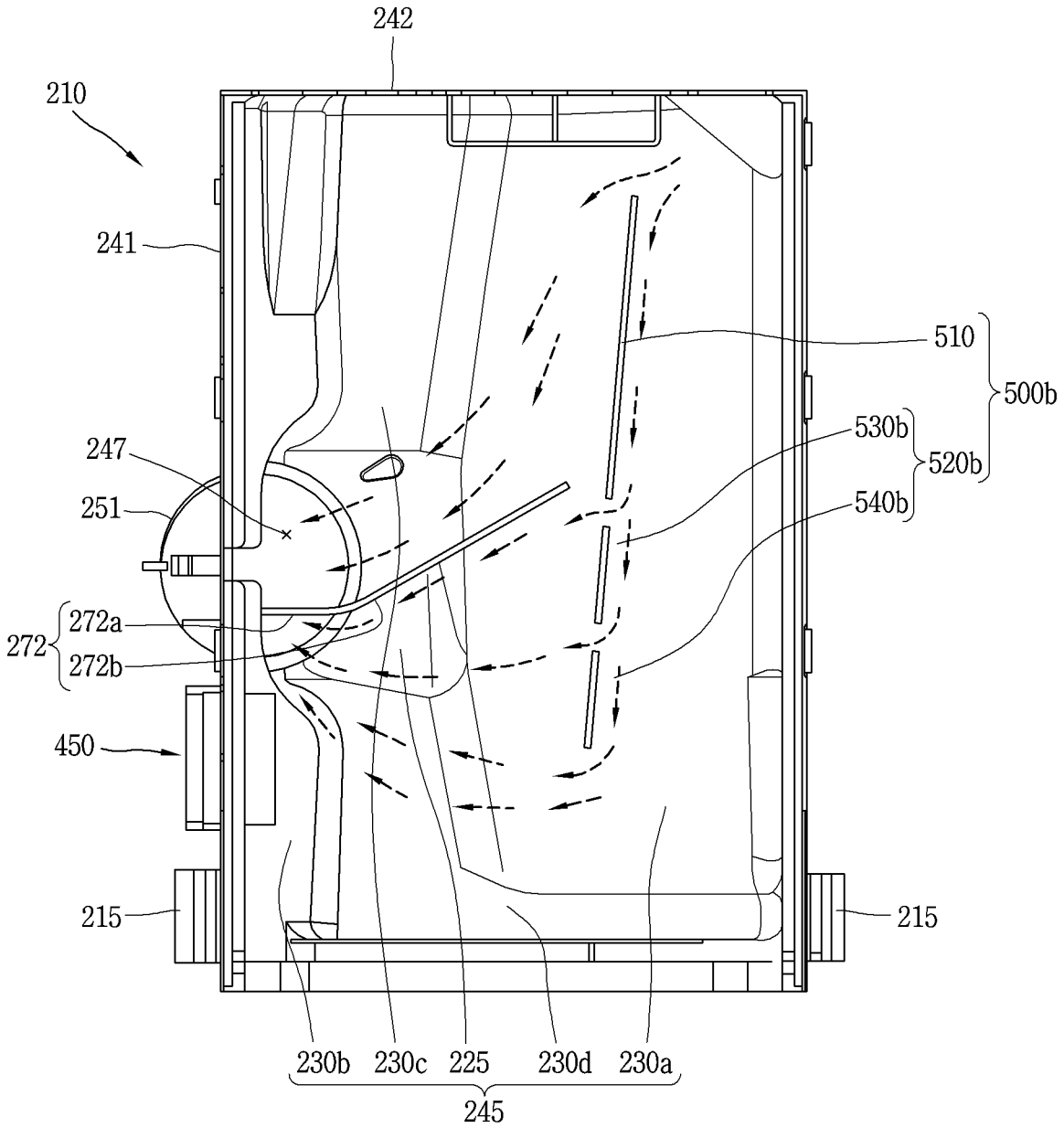
FIG. 20 is a view illustrating an operation of the wash water guide unit of FIG. 19.
Figure 21:
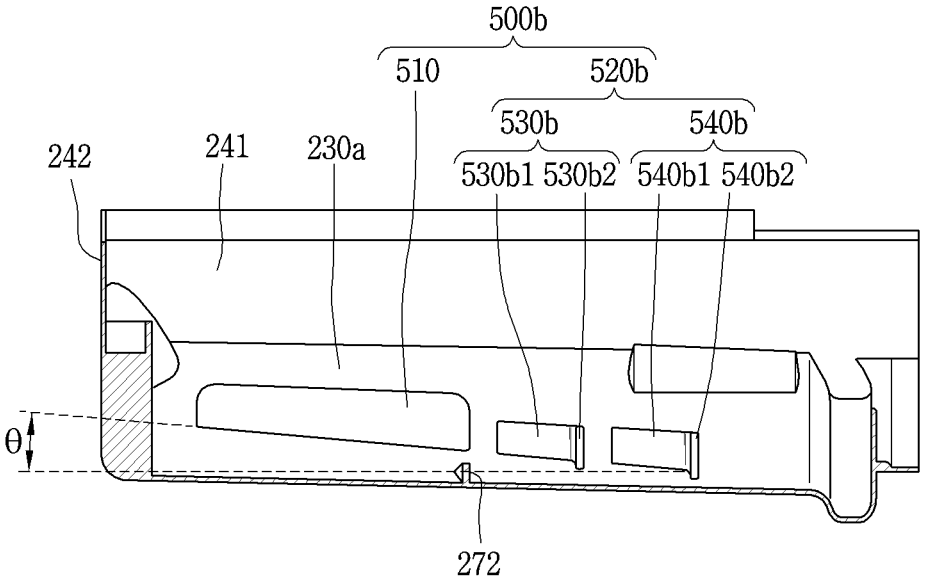
FIG. 21 is a view illustrating a modified example of the wash water guide unit of FIG. 19.

FIG. 18 is a perspective view of a housing 210 of a laundry treating apparatus in accordance with another embodiment, FIG. 19 is a partial cross-sectional view illustrating a wash water guide unit of FIG. 18, FIG. 20 is a view illustrating an operation of the wash water guide unit of FIG. 19, and FIG. 21 is a view illustrating a modified example of the wash water guide unit of FIG. 19. As illustrated in FIGS. 18 and 19, the housing 210 of the laundry treating apparatus according to this embodiment, as aforementioned, has the shape with the upper and front openings. The housing 210 is provided with a through portion 247 communicating with the water tub 140, and a plurality of inclined sections 230 by which wash water can be moved to the through portion 247.

As illustrated in FIG. 20, a horizontal partition 272 is provided above the through portion 247.

Referring to FIGS. 18 and 19 again, a wash water guide unit 500*b* is formed at one side of the horizontal partition 272 to guide the wash water such that a plurality of wash water movement paths is formed at the front region of the horizontal partition 272.

The wash water guide unit 500*b* may include a vertical partition 510 protruding at one side of the horizontal partition 272 and disposed in the back and forth direction of the horizontal partition 272, and an extension partition 520*b* formed at the front of the vertical partition 510 in a spaced manner.

Here, the vertical partition 510 extends forward to be inclined downward. This may allow the wash water moved along the vertical partition 510 to be moved smoothly.

The vertical partition 510 has a substantially rectangular plate shape.

The extension partition 520*b* includes a first extension partition 530*b* formed at the front of the vertical partition 510 in a spaced manner, and a second extension partition 540*b* formed at the front of the first extension partition 530*b* in a spaced manner. The first extension partition 530*b* and the second extension partition 540*b* each have a rectangular plate shape.

The extension partition 520*b* is disposed on an extension line of the vertical partition 510.

Referring to FIG. 19, the vertical partition 510, the first extension partition 530*b*, and the second extension partition 540*b* are inclined downward with a predetermined inclination angle θ with respect to a horizontal line. As a result, the wash water dropped via the pre-detergent storage portion 316 can be smoothly moved to the front region of the housing 210.

With this configuration, as illustrated in FIG. 20, part of the wash water dropped to the rear region of the first inclined section 230*a* via the pre-detergent storage portion 316 is moved to the rear region of the horizontal partition 272 via the rear of the vertical partition 510.

Another part of the wash water dropped via the pre-detergent storage portion 316 is moved along the vertical partition 510, and then moved to the front region of the horizontal partition 272 through between the vertical partition 510 and the first extension partition 530*b*, so as to form a first path P1. Another part of the wash water moved along the vertical partition 510 is moved along the first extension partition 530*b*, and then moved downward through between the first extension partition 530*b* and the second extension partition 540*b*, so as to form a second path P2. Another part of the wash water moved along the first extension partition 530*b* is moved forward along the second extension partition 530*b*, and then moved via the forefront of the housing 210, so as to form a third path P3. Accordingly, the detergent remaining at the front region of the housing 210 can be washed out by the wash water moved along the plurality of movement paths formed at the inner front region of the housing 210, thereby suppressing the detergent residue at the inner front region of the housing 210.

On the other hand, as illustrated in FIG. 21, the first extension partition 530*b* of the wash water guide unit 500*b* may be provided with a first extension partition body 530*b*1, and a first bent end portion 530*b*2 bent from the first extension partition body 530*b*1. The second extension partition 540*b* of the wash water guide unit 500*b* may be provided with a second extension partition body 540*b*1, and a second bent end portion 540*b*2 bent from the second extension partition body 540*b*1. With this configuration, wash water and detergent moved along the first extension partition body 530*b*1 can be stably moved downward by the guide of the first bent end portion 530*b*2. Also, wash water and detergent moved along the second extension partition body 540*b* can be stably moved downward by the guide of the second bent end portion 540*b*2.

Figure 22:
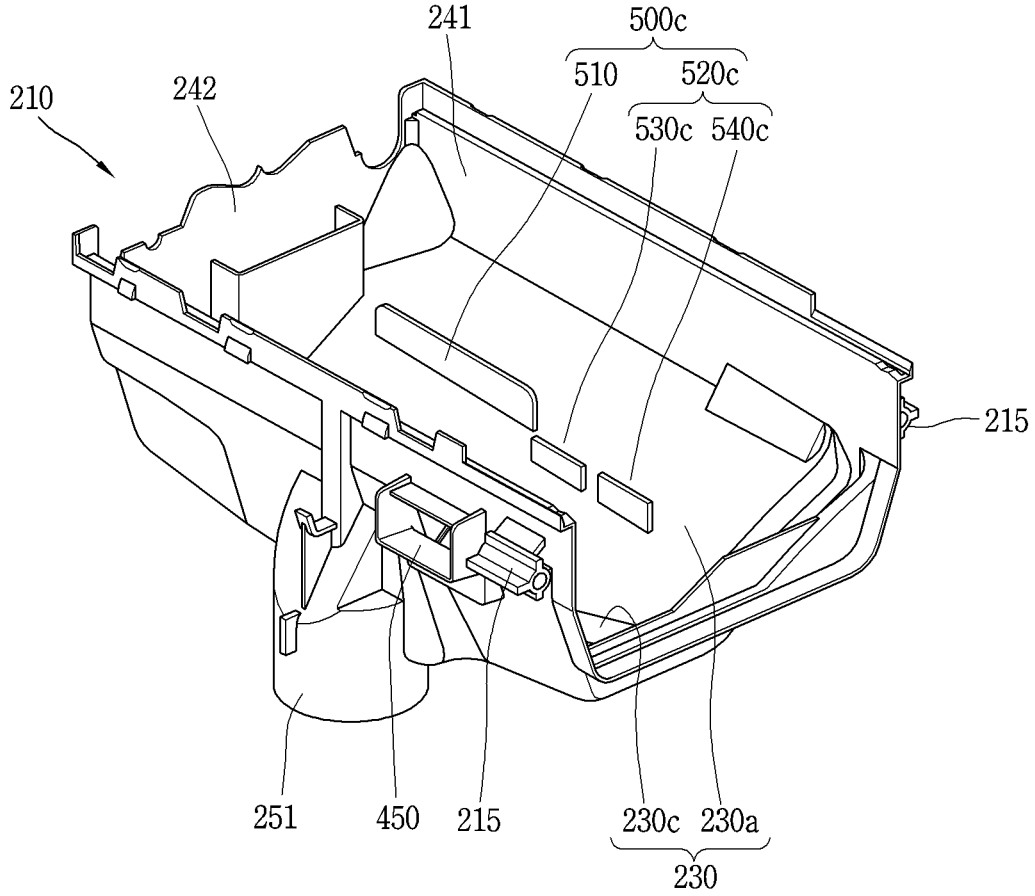
FIG. 22 is a perspective view of a housing of a laundry treating apparatus in accordance with another embodiment.
Figure 23:
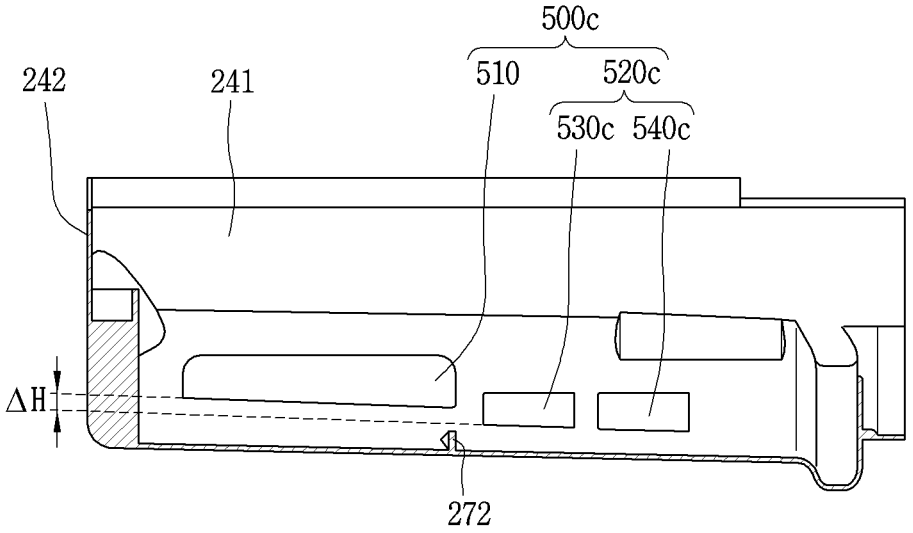
FIG. 23 is a partial cross-sectional view illustrating a wash water guide unit of FIG. 22.
Figure 24:
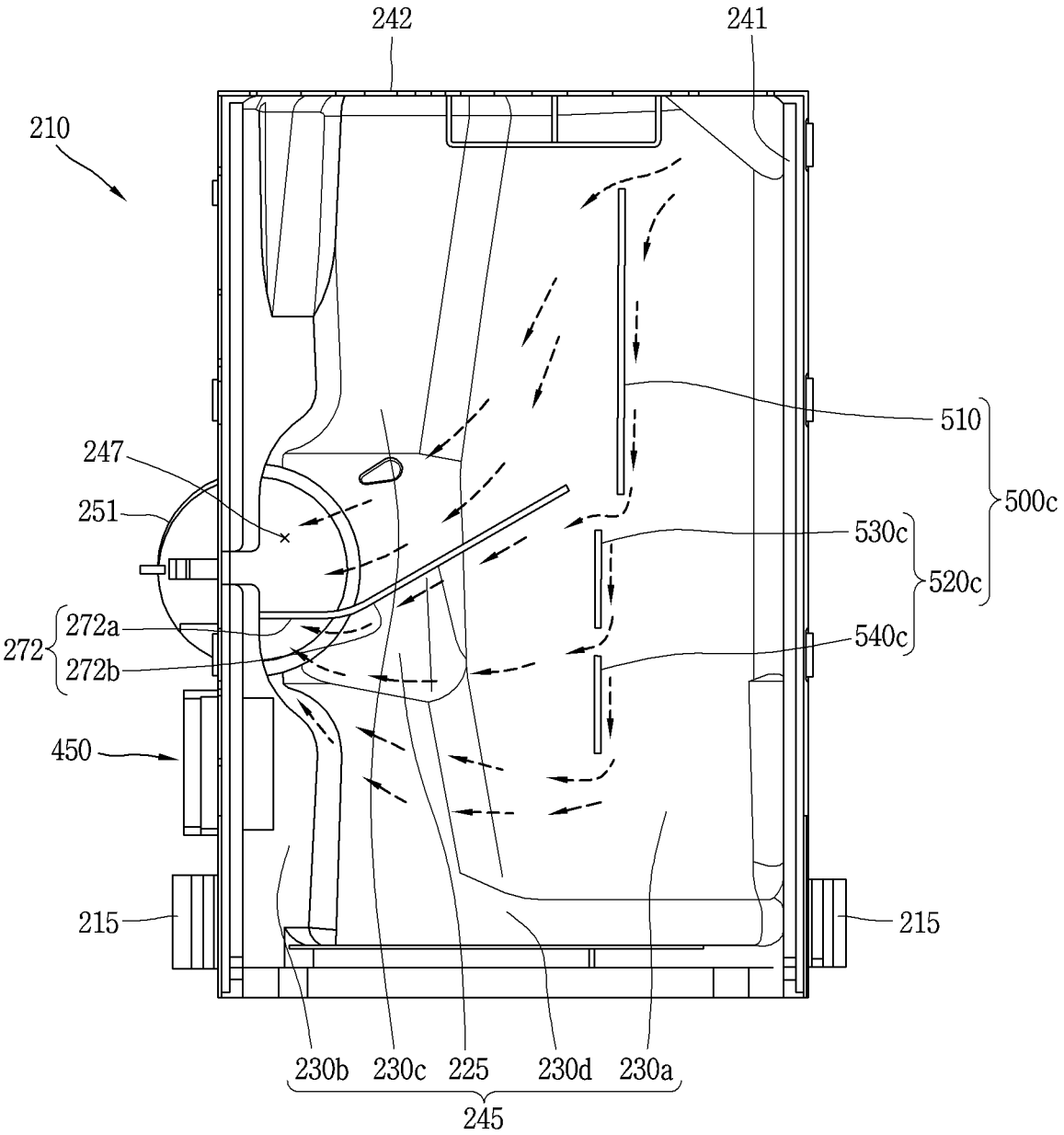
FIG. 24 is a view illustrating an operation of the wash water guide unit of FIG. 23.
Figure 25:
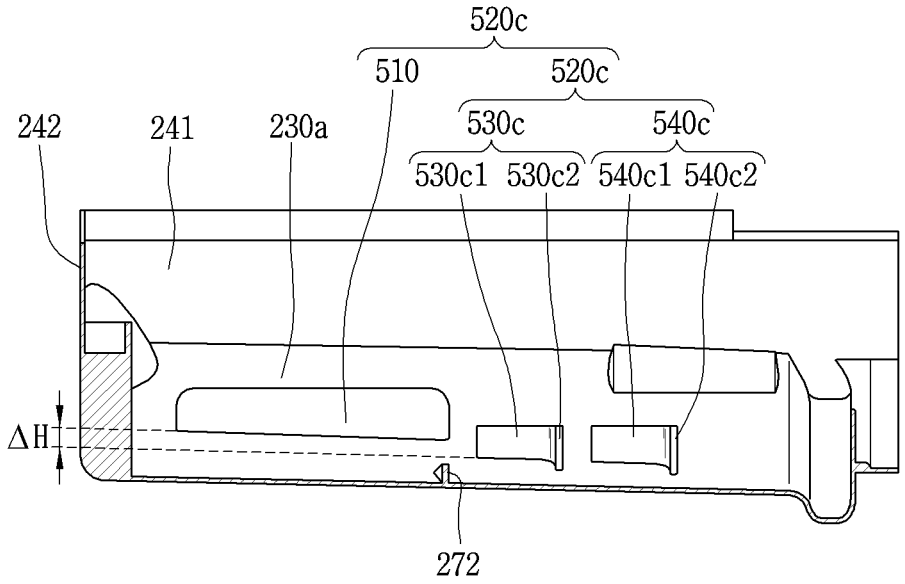
FIG. 25 is a view illustrating a modified example of the wash water guide unit of FIG. 23.
Figure 26:
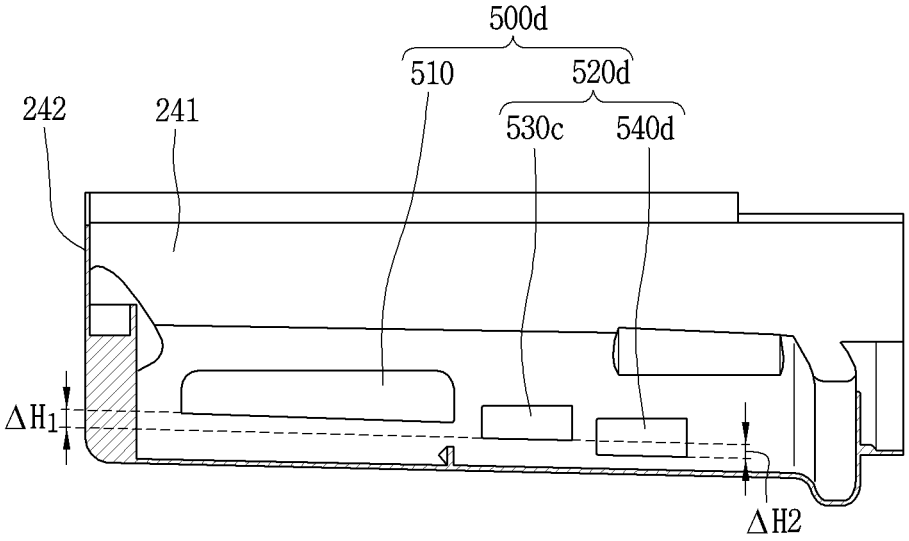
FIG. 26 is a view illustrating another modified example of the wash water guide unit of FIG. 23.
Figure 27:
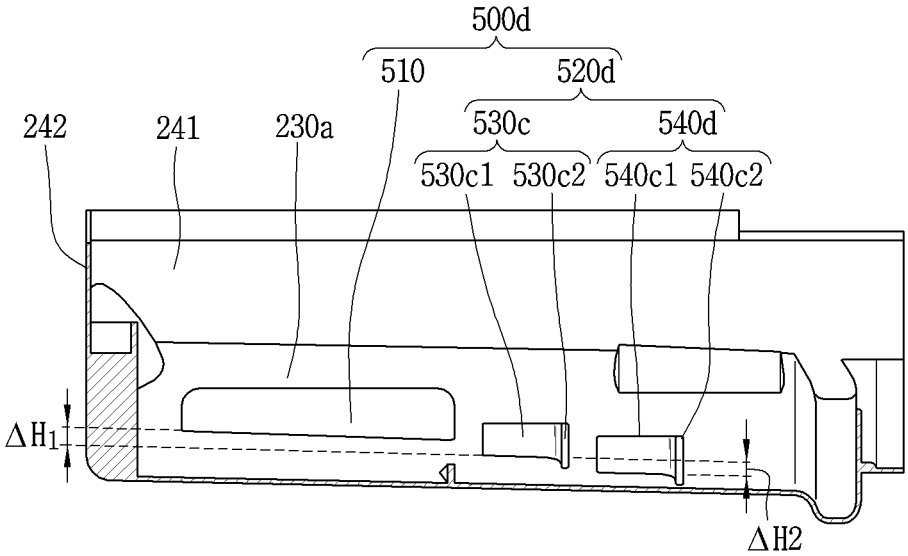
FIG. 27 is a view illustrating still another modified example of the wash water guide unit of FIG. 26.

FIG. 22 is a perspective view of a housing 210 of a laundry treating apparatus in accordance with another embodiment. FIG. 23 is a partial cross-sectional view illustrating a wash water guide unit 500*c* of FIG. 22, FIG. 24 is a view illustrating an operation of the wash water guide unit 500*c* of FIG. 23, FIG. 25 is a view illustrating a modified example of the wash water guide unit 500*c* of FIG. 23, FIG. 26 is a view illustrating another modified example of the wash water guide unit 500*c* of FIG. 23, and FIG. 27 is a view illustrating still another modified example of the wash water guide unit 500*c* of FIG. 26. As illustrated in FIGS. 22 and 23, the housing 210 of this embodiment includes a through portion 247 communicating with the water tub 140, and a plurality of inclined sections 230 inclined toward the through portion 247.

A horizontal partition 272 is formed above the through portion 247.

The housing 210 is provided with a wash water guide unit 500*c* for guiding wash water such that a plurality of wash water movement paths is formed at the front of the horizontal partition 272.

The wash water guide unit 500*c* may include a vertical partition 510 protruding at one side of the horizontal partition 272 and disposed in the back and forth direction of the horizontal partition 272, and an extension partition 520*c* formed at the front of the vertical partition 510 with being spaced apart from the vertical partition 510.

The vertical partition 510 has a substantially rectangular plate shape.

On the other hand, the extension partition 520*c* is formed below the vertical partition 510 with a height difference ΔH from the vertical partition 510. With this configuration, the wash water can be moved to an upper surface of the extension partition 520*c* while being dropped from the vertical section 510, so as to be smoothly moved.

The extension partition 520*c* includes a first extension partition 530*c* spaced apart from the vertical partition 510, and a second extension partition 540*c* formed at the front of the first extension partition 530*c* in a spaced manner. The first extension partition 530*c* and the second extension partition 540*c* each have a rectangular plate shape.

With such a configuration, part of the wash water dropped into the rear region of the first inclined section 230*a* via the pre-detergent storage portion 316 is moved to the rear region of the horizontal partition 272 through between the vertical partition 510 and the rear portion 242.

Another part of the wash water dropped via the pre-detergent storage portion 316 is moved along the vertical partition 510, and then moved downward through between the vertical partition 510 and the first extension partition 530*c*, so as to form a first path P1. Another part of the wash water moved along the vertical partition 510 is moved along the first extension partition 530*c*, and then moved downward through between the first extension partition 530*c* and the second extension partition 540*c*, so as to form a second path P2. Another part of the wash water moved along the first extension partition 530*c* is moved along the second extension partition 540*c*, and then moved via the forefront region of the housing 210, so as to form a third path P3. Accordingly, the detergent remaining at the inner front region of the housing 210 can be washed out by the wash water moved along the plurality of movement paths formed at the inner front region of the housing 210, thereby suppressing the detergent residue in the housing 210.

On the other hand, as illustrated in FIG. 25, the first extension partition 530*c* may be provided with a first extension partition body 530*c*1, and a first bend end portion 530*c*2 bent downward from the first extension partition body 530*c*1. The second extension partition 540*c* may be provided with a second extension partition body 540*c*1, and a second bent end portion 540*c*2 bent downward from the second extension partition body 540*c*1.

In addition, as illustrated in FIG. 26, the first extension partition 530*c* may be disposed below the vertical partition 510 with a first height difference ΔH1, and a second extension partition 540*d* may be disposed below the first extension partition 530*c* with a second height difference ΔH2. Here, the first height difference ΔH1 and the second height difference ΔH2 may also be set to the same value.

In addition, as illustrated in FIG. 27, the first extension partition 530*c* and the second extension partition 540*d* may be disposed with a height difference ΔH2 therebetween, and the first extension partition 530*c* may be provided with a first extension partition body 530*c*1, and a first bent end portion 530*c*2 bent downward from the first extension partition body 530*c*1. The second extension partition 540*d* may be provided with a second extension partition body 540*d*1, and a second bent end portion 540*d*2 bent downward from the second extension partition body 540*d*1. This may result in mitigating a decrease in movement speed of the wash water, and allowing smooth downward movement of the wash water.

Hereinafter, a laundry treating apparatus in accordance with another embodiment will be described with reference to FIGS. 28 to 31.

Figure 28:
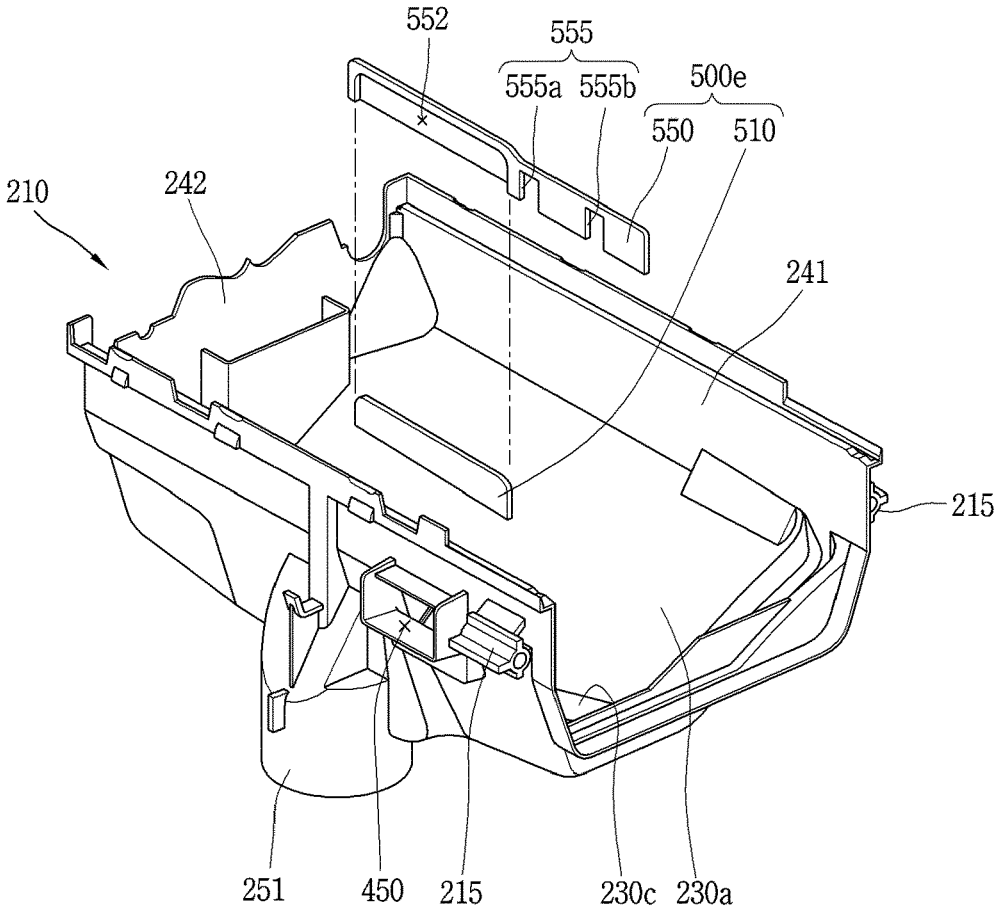
FIG. 28 is an exploded perspective view illustrating a main part of a housing of a laundry treating apparatus in accordance with another embodiment.
Figure 29:
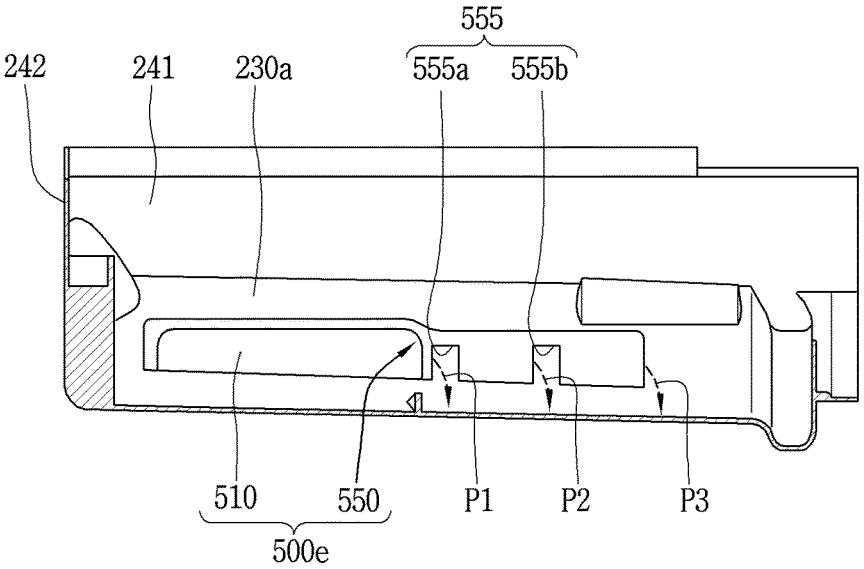
FIG. 29 is a partial cross-sectional view illustrating a coupled state of a wash water guide unit of FIG. 28.
Figure 30:
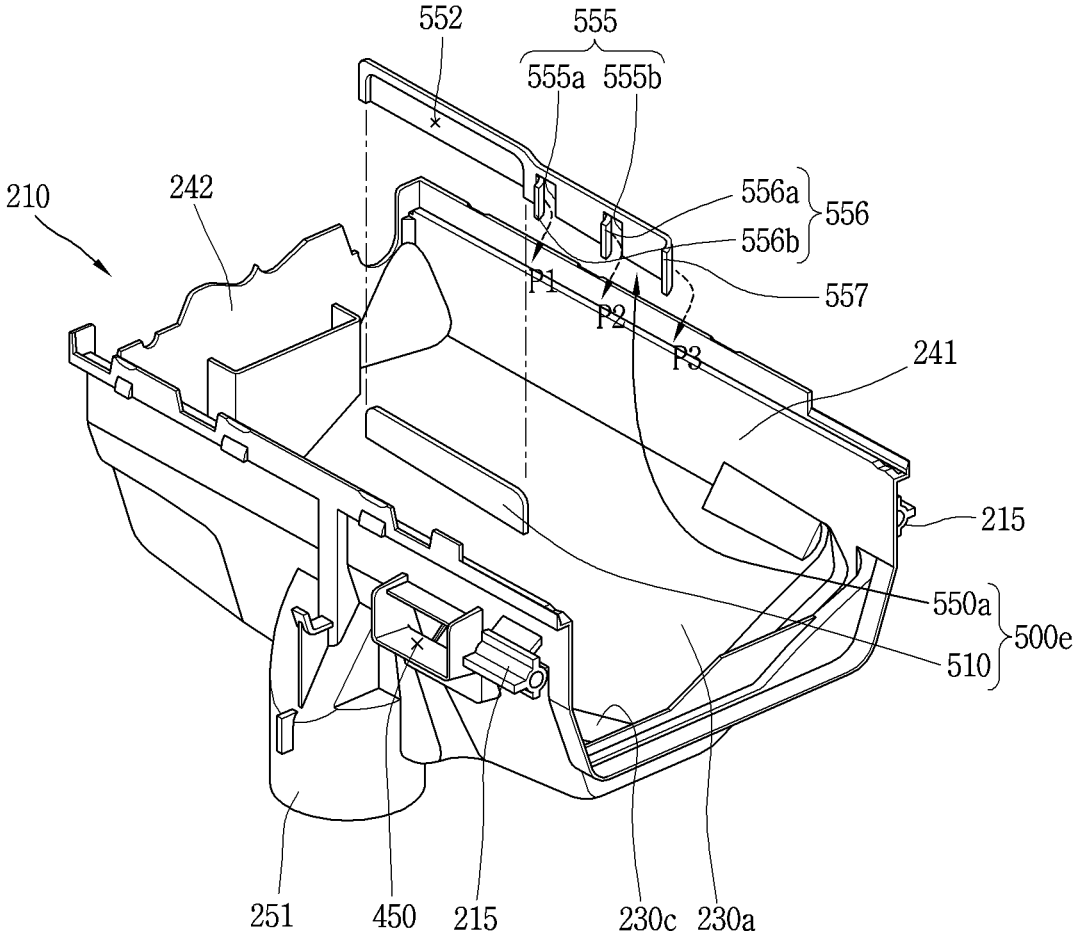
FIG. 30 is a view illustrating a modified example of the wash water guide unit of FIG. 28.

FIG. 28 is a perspective view illustrating a main part of a housing 210 of a laundry treating apparatus in accordance with another embodiment, FIG. 29 is a partial cross-sectional view illustrating a coupled state of a wash water guide unit 500*e* of FIG. 28, and FIG. 30 is a view illustrating a modified example of the wash water guide unit 500*e* of FIG. 28. As illustrated in FIGS. 28 and 29, the housing 210 of the laundry treating apparatus according to this embodiment, as aforementioned, has the shape with upper and front openings. The housing 210 may include a through portion 247 communicating with the water tub 140, and plurality of inclined sections 230 inclined to allow wash water to be moved toward the through portion 247.

A horizontal partition 272 is provided above the through portion 247.

The housing 210 is provided with a wash water guide unit 500*e* for guiding wash water such that a plurality of wash water movement paths is formed at the front region of the horizontal partition 272.

The wash water guide unit 500*e* includes a vertical partition 510 protruding from a bottom surface of the housing 210 at one side of the horizontal partition 272 and disposed in a back and forth direction of the housing 210, and a guide member 550 extending in the back and forth direction of the housing 210 with being coupled to the vertical partition 510 and having an outlet 555 through which wash water can flow to the front of the horizontal partition 272.

As a result, various wash water movement paths can be defined at the front region of the horizontal partition 272 by adjusting a length of the guide member 550, and number and size of the outlet 555.

Here, a coupling portion 552 is formed in the guide member 550 such that the guide member 550 can be coupled to the vertical partition 510.

The coupling portion 552 is recessed into the guide member 550 in a thickness direction of the guide member 550.

In this embodiment, it is exemplarily illustrated that the guide member 550 is coupled to an upper portion of the vertical partition 510 in the thickness direction, but this is merely illustrative. Alternatively, the coupling portion of the guide member 550 may be coupled to the vertical partition 510 in a height direction of the vertical partition 510.

The coupling portion 552 is recessed upward into a bottom surface of the guide member 550 in the drawing.

The guide member 550 is formed longer than the vertical partition 510.

The guide member 550 has a substantially rectangular plate shape.

The guide member 550 is provided with the outlet 555 formed at a portion thereof spaced apart from the vertical partition 510 so that the wash water can flow therethrough. The outlet 555 is formed through the guide member 550 at a position where the wash water moved downward through the outlet 555 can define a movement path at the front of the horizontal partition 272.

The outlet 555 may be provided by at least one in number. With such a configuration, a first wash water movement path may be defined through the outlet 555, and a second wash water movement path may be defined by wash water dropped at the front end of the guide member 550.

The outlet 555 is provided with a first outlet 555*a* formed a point spaced a predetermined distance from a front end of the horizontal partition 510, and a second outlet 555*b* formed at a position a predetermined distance from a front end of the first outlet 555*a*. The first outlet 555*a* is formed to define a first path P1 along which the wash water is moved to the front of the horizontal partition 272. The second outlet 555*b* is formed to define a second path P2 along which the wash water is moved with being spaced forward from the first path P1. The guide member 550 is formed to have a length by which the wash water dropped from its front end portion can be moved via an inner forefront of the housing 210 (the third inclined section 230*c*).

Here, the vertical partition 510 may be inclined downward at a preset angle toward the front of the housing 210. With this configuration, the guide member 550 can be inclined downward to the front region of the housing 210, which may facilitate the wash water to be smoothly moved along the guide member 550.

With this configuration, the guide member 550 is aligned above the vertical partition 510, and then pressed down so that the vertical partition 510 is inserted into the coupling portion 552 of the guide member 550. Accordingly, the guide member 550 can be coupled to an upper surface of the vertical partition 510.

Part of the wash water dropped to the rear region of the housing 210 via the pre-detergent storage portion 316 is moved downward through between the guide member 550 and the rear portion 242, and then moved to the rear region of the horizontal partition 272. Another part of the wash water dropped via the pre-detergent storage portion 316 is moved forward along the guide member 550, and is moved downward through the first outlet 555*a*, so as to define a first path P1 toward the front of the horizontal partition 272. Part of the wash water moved along the guide member 550 is moved downward through the second outlet 555*b*, so as to define a second path P2. Another part of the wash water moved along the guide member 550 is dropped at the front end portion of the guide member 550 and flows via the forefront of the housing 210, so as to define a third path P3. Accordingly, the detergent at the inner front region of the housing 210 can be washed out by the wash water moved along the respective paths, thereby suppressing the detergent residue.

On the other hand, as illustrated in FIG. 30, the guide member 550 of the wash water guide unit is provided with a rib 556 extending downward from the outlet 555. The rib 556 is provided with a first rib 556*a* extending downward from the first outlet 555*a* and a second rib 556*b* extending downward from the second outlet 555*b*. The guide member 550 is provided with a bent end portion 557 bent downward from the front end portion thereof.

With this configuration, when part of the wash water moved along the guide member 550 is moved downward through the first outlet 555*a* and the second outlet 555*b*, the first rib 556*a* and the second rib 556*b* can prevent the wash water from being moved to a lower rear side of the first outlet 555*a* and the second outlet 555*b*, so that the wash water can be stably moved downward of the outlet 555.

Figure 31:
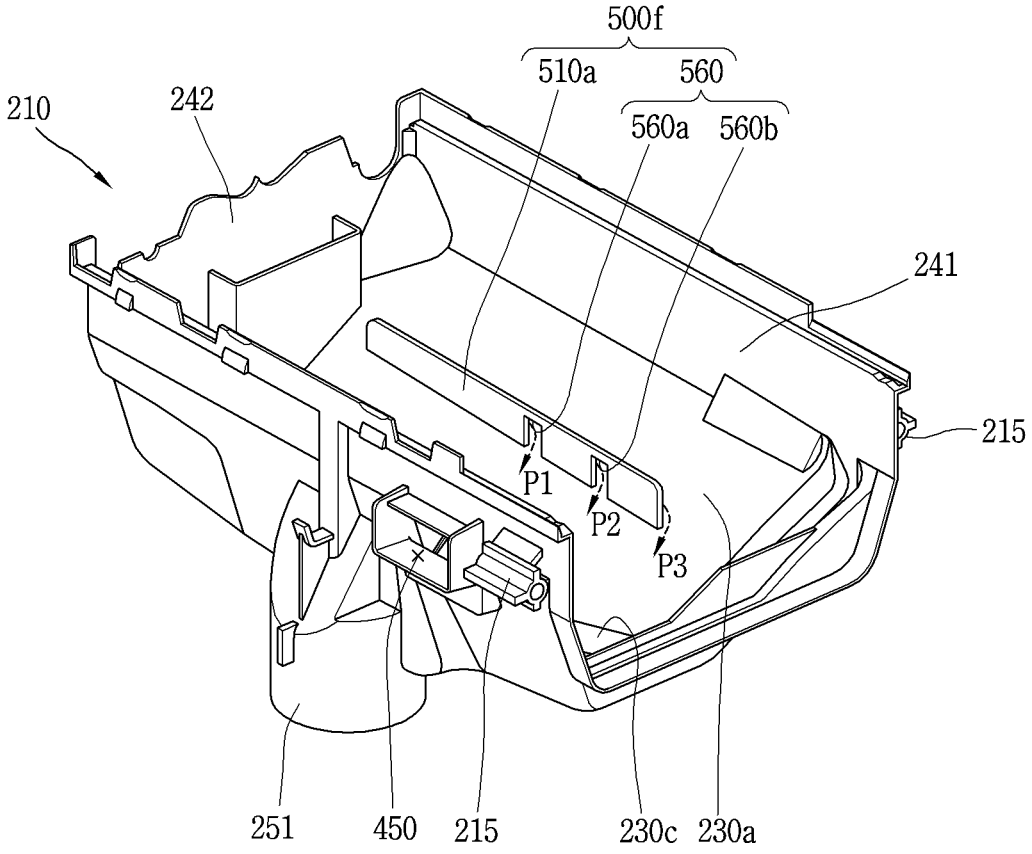
FIG. 31 is an exploded perspective view illustrating a main part of a housing of a laundry treating apparatus in accordance with another embodiment.

FIG. 31 is an exploded perspective view illustrating a main part of a housing 210 of a laundry treating apparatus in accordance with another embodiment. The housing 210 of the laundry treating apparatus according to this embodiment, as aforementioned, has the shape with upper and front openings. A through portion 247 is formed through a bottom of the housing 210 to communicate with the water tub 140. The through portion 247 is provided with a horizontal partition 272.

The housing 210 is provided with a wash water guide unit 500*f* located at one side of the horizontal partition 272 to guide wash water such that a plurality of wash water movement paths is defined at the front region of the horizontal partition 272.

As illustrated in FIG. 31, the wash water guide unit 500*f* is provided with a vertical partition 510*a* protruding from a bottom surface of the housing 210 at one side of the horizontal partition 272 and disposed in a back and forth direction, and an outlet 560 formed through the vertical partition 510*a* so that wash water flows therethrough.

With this configuration, part of the wash water moved along the vertical partition 510*a* is moved downward through the outlet 560 so as to define a first wash water movement path, and another part is moved downward from a front end portion of the vertical partition 510*a* and moved via an inner forefront region of the housing 210, so as to define a second wash water movement path. Accordingly, the plurality of wash water movement paths can be defined at the front region of the horizontal partition 272, thereby preventing the detergent residue at the inner front region of the housing 210.

The vertical partition 510*a* is disposed in the back and forth direction of the housing 210.

The vertical partition 510*a* is configured to have a length extending over the horizontal partition 272 to the front region of the housing 210.

The vertical partition 510*a* is implemented in a rectangular plate shape.

The vertical partition 510*a* protrudes upward in the first inclined section 230*a*.

The vertical partition 510*a* is spaced a preset distance apart from the rear portion 242 of the housing 210.

Here, the vertical partition 510*a* is formed horizontally toward the front of the housing 210. The vertical partition 510*a* may alternatively inclined downward toward the front of the housing 210.

The outlet 560 is formed at a position where the wash water moved downward through the outlet 560 can be moved to the front region of the horizontal partition 272.

The outlet 560 is provided with a first outlet 560*a* formed at a point spaced a preset distance apart from a rear end portion of the vertical partition 510*a*, and a second outlet 560*b* spaced forward a preset distance apart from the first outlet 560*a*.

The first outlet 560*a* and the second outlet 560*b* are formed to be open toward the first inclined section 230*a*, respectively.

Here, the first outlet 560*a* and the second outlet 560*b* may also be provided with ribs extending downward, as described above with reference to FIG. 30. In addition, the vertical partition 510*a* may be provided with the bent end portion bent downward from the front end portion thereof, as described above with reference to FIG. 30.

Accordingly, part of the wash water dropped via the pre-detergent storage portion 316 is moved downward through between the vertical partition 510*a* and the rear portion 242 and then moved to the rear region of the horizontal partition 272.

Another part of the wash water dropped via the pre-detergent storage portion 316 is moved forward along the vertical partition 510*a*, and then moved downward through the first outlet 560*a* so as to flow toward the front of the horizontal partition 272, thereby defining a first path P1.

Part of the wash water moved along the vertical partition 510*a* is moved downward through the second outlet 560*b* and then moved at a region spaced forward from the first path P1, thereby defining a second path P2.

Another part of the wash water moved along the vertical partition 510*a* is moved downward along the front end portion and then moved via the forefront region (third inclined section 230*c*) in the housing 210, thereby defining a third path P3.

The detergent remaining at the front region of the horizontal partition 272 over the horizontal partition 272 can be washed out by the wash water moved along the first path P1, the second path P2, and the third path P3, so as to be supplied into the water tub 140 through the through portion 247. This may result in suppressing the detergent residue at the inner front region of the housing 210.

The foregoing description has been given of specific embodiments of the present disclosure. However, the present disclosure may be embodied in various forms without departing from the spirit or essential characteristics thereof, and thus the above-described embodiments should not be limited by the details of the detailed description. In addition, even embodiments not listed in the detailed description should be interpreted within the scope of the technical idea defined in the appended claims. It is intended that the present disclosure cover the modifications and variations of this disclosure provided they come within the scope of the appended claims and their equivalents.

What is claimed is:

1. A laundry treating apparatus, comprising:

a cabinet;

a water tub disposed inside the cabinet; and a detergent box configured to supply detergent to the water tub, the detergent box comprising:

a housing that is in communication with the water tub, a drawer configured to be received in the housing and to be drawn out from the housing, the drawer having a plurality of detergent storage spaces defined therein, and a distribution unit configured to supply wash water to the plurality of detergent storage spaces, wherein the housing comprises:

a through portion that is in communication with the water tub, a horizontal partition that protrudes from a bottom surface of the housing, that extends vertically above the through portion, and that extends in a left-right direction of the housing, a plurality of inclined sections by which wash water is moved to the through portion, and a wash water guide that is configured to guide wash water in the housing toward a front region of the horizontal partition, the wash water guide defining a plurality of wash water movement paths toward the front region of the horizontal partition, wherein the wash water guide comprises:

a vertical partition that protrudes from the bottom surface of the housing, that is disposed at one side of the horizontal partition, and that extends in a front-rear direction of the housing, and an extension partition spaced apart from the vertical partition in the front-rear direction of the housing and disposed forward relative to the vertical partition, and wherein the plurality of wash water movement paths comprise:

a first path that is defined along a front region of the horizontal partition and configured to carry wash water downward from a first space defined between the vertical partition and a rear end of the extension partition, and a second path that is defined forward relative to the first path and configured to carry wash water downward from a second space defined at a front end of the extension partition.

2. The apparatus of claim 1, wherein the extension partition comprises:

a first extension partition spaced apart from an end of the vertical partition and disposed forward relative to the vertical partition; and a second extension partition spaced apart from an end of the first extension partition and disposed forward relative to the first extension partition.

3. The apparatus of claim 2, wherein the first extension partition comprises a first extension partition body that extends in the front-rear direction and a first bent end portion that is curved from an end portion of the first extension partition body, and wherein the second extension partition comprises a second extension partition body that extends in the front-rear direction and a second bent end portion that is curved from an end portion of the second extension partition body.

4. The apparatus of claim 2, wherein a first height of the first extension partition is less than a height of the vertical partition with respect to the bottom surface of the housing, and wherein a second height of the second extension partition is less than the first height of the first extension partition with respect to the bottom surface of the housing.

5. The apparatus of claim 1, wherein a height of the extension partition is less than a height of the vertical partition with respect to the bottom surface of the housing.

6. The apparatus of claim 1, wherein the vertical partition and the extension partition are inclined downward toward a front portion of the housing.

7. The apparatus of claim 1, wherein the housing comprises a ventilation portion that is in communication with an inside of the housing and an outside of the housing, and wherein an upper end portion of the horizontal partition is located vertically lower than the ventilation portion.

8. The apparatus of claim 1, wherein the plurality of detergent storage spaces of the drawer comprise:

a main detergent storage portion configured to store first detergent to be used during a main-wash process;

a pre-detergent storage portion configured to store second detergent to be used during a pre-wash process; and a fabric softener storage portion configured to store fabric softener, and wherein the wash water guide is configured to guide, to the front region of the horizontal partition along the plurality of wash water movement paths, wash water suppled through the pre-detergent storage portion.

9. The apparatus of claim 8, wherein the through portion has a circular cross section, and wherein the horizontal partition divides the through portion into a front portion and a rear portion and is disposed forward relative to a center of the through portion.

10. The apparatus of claim 9, wherein the housing comprises:

a horizontal section that defines the bottom surface of the housing and that defines the through portion; and a plurality of inclined sections that are inclined with respect to the horizontal section and that extend toward the through portion, and wherein the plurality of inclined sections comprises a first inclined section that extends downward to the horizontal section in the left-right direction of the housing, wherein the horizontal partition is disposed on the horizontal section and the first inclined section, and wherein the wash water guide is disposed on the first inclined section.

11. The apparatus of claim 8, wherein the housing defines an inner rear region configured to receive wash water that is suppled through the pre-detergent storage portion and dropped down to the housing, and wherein the wash water guide is spaced apart from a rear end portion of the housing and configured to guide a part of the wash water suppled through the pre-detergent storage portion to a rear region of the horizontal partition.

12. The apparatus of claim 1, wherein both of the vertical partition and the extension partition extend along the front-rear direction of the housing.

13. A laundry treating apparatus comprising:

a cabinet;

a water tub disposed inside the cabinet; and a detergent box configured to supply detergent to the water tub, the detergent box comprising:

a housing that is in communication with the water tub, a drawer configured to be received in the housing and to be drawn out from the housing, the drawer having a plurality of detergent storage spaces defined therein, and a distribution unit configured to supply wash water to the plurality of detergent storage spaces, wherein the housing comprises:

a through portion that is in communication with the water tub, a horizontal partition that protrudes from a bottom surface of the housing, that extends vertically above the through portion, and that extends in a left-right direction of the housing, and a wash water guide that is configured to guide wash water in the housing toward a front region of the horizontal partition, the wash water guide defining a plurality of wash water movement paths toward the front region of the horizontal partition, and wherein the wash water guide comprises:

a vertical partition that protrudes from the bottom surface of the housing, that is disposed at one side of the horizontal partition, and that extends in a front-rear direction of the housing, the vertical partition defining at least one outlet that allows wash water to be suppled therethrough the front region of the horizontal partition.

14. The apparatus of claim 13, wherein the at least one outlet comprises:

a first outlet that is defined at a front portion of the vertical partition and that allows wash water to be supplied to the front region of the horizontal partition; and a second outlet is defined at a position forward of the first outlet and that allows wash water to be supplied to the front region of the horizontal partition.

15. The apparatus of claim 13, wherein the vertical partition is inclined downward toward a front portion of the housing.

16. The apparatus of claim 13, wherein the at least one outlet is defined at a boundary region between the vertical partition and the bottom surface of the housing.

17. The apparatus of claim 13, wherein the wash water guide further comprises a rib that faces the at least one outlet and that extends toward the front region of the horizontal partition.

18. A laundry treating apparatus comprising:

a cabinet;

a water tub disposed inside the cabinet; and a detergent box configured to supply detergent to the water tub, the detergent box comprising:

a housing that is in communication with the water tub, a drawer configured to be received in the housing and to be drawn out from the housing, the drawer having a plurality of detergent storage spaces defined therein, and a distribution unit configured to supply wash water to the plurality of detergent storage spaces, wherein the housing comprises:

a through portion that is in communication with the water tub, a horizontal partition that protrudes from a bottom surface of the housing, that extends vertically above the through portion, and that extends in a left-right direction of the housing, and a wash water guide that is configured to guide wash water in the housing toward a front region of the horizontal partition, the wash water guide defining a plurality of wash water movement paths toward the front region of the horizontal partition, and wherein the wash water guide comprises:

a vertical partition that protrudes from the bottom surface of the housing, that is disposed at one side of the horizontal partition, and that extends in a front-rear direction of the housing, and a guide member that is coupled to the vertical partition, that extends in the front-rear direction of the housing, and that defines at least one outlet that allows wash water to be supplied to the front region of the horizontal partition.

19. The apparatus of claim 18, wherein the guide member comprises a coupling portion coupled to the vertical partition.

20. The apparatus of claim 19, wherein the coupling portion is recessed from a side surface of the guide member in a thickness direction of the guide member.

* * * * *